US005302161A

United States Patent [19]

Loubert et al.

[11] Patent Number: 5,302,161

[45] Date of Patent: Apr. 12, 1994

[54] FLEXIBLE LINE GUIDANCE AND TENSION MEASURING DEVICE

[75] Inventors: Craig A. Loubert, Minneapolis; Stephen S. Peterson, Maple Grove; Timothy S. Engel, Mound, all of Minn.

[73] Assignee: NoordicTrack, Inc., Chaska, Minn.

[21] Appl. No.: 835,186

[22] Filed: Feb. 13, 1992

Related U.S. Application Data

[63] Continuation-in-part of Ser. No. 791,073, Nov. 12, 1991, Pat. No. 5,195,937, and a continuation-in-part of Ser. No. 769,549, Oct. 1, 1991, and a continuation-in-part of Ser. No. 500,517, Mar. 28, 1990, Pat. No. 5,090,694.

[51] Int. Cl.[5] ..... A63B 21/00

[52] U.S. Cl. ..... 482/8; 482/99; 482/116; 482/119; 482/133; 482/909; 73/379.06

[58] Field of Search ..... 482/1-9, 482/99-103, 112-120, 130, 133, 135-139, 909; 73/379-381

[56] References Cited

U.S. PATENT DOCUMENTS

| | | | |
|---|---|---|---|
| 3,635,472 | 1/1972 | Marcyan | 482/101 |
| 3,640,530 | 2/1972 | Henson et al. | 73/379 X |
| 3,861,215 | 1/1975 | Bradley | 482/116 |
| 3,896,672 | 7/1975 | Henson et al. | 73/379 |
| 3,989,241 | 11/1976 | Oorgant . | |
| 4,072,309 | 2/1978 | Wilson . | |
| 4,138,106 | 2/1979 | Bradley | 482/116 X |
| 4,199,139 | 4/1980 | Mahnke et al. | 482/101 |
| 4,235,439 | 11/1980 | De Donno | 482/909 X |
| 4,349,192 | 9/1982 | Lambert, Jr. et al. | 482/101 |
| 4,397,462 | 8/1983 | Wilmarth | 482/137 X |
| 4,628,910 | 12/1986 | Krukowski | 482/5X |
| 4,643,420 | 2/1987 | Bilet et al. | 482/130 |
| 4,678,185 | 7/1987 | Mahnke . | |
| 4,691,694 | 9/1987 | Boyd et al. | 482/8 X |
| 4,721,303 | 1/1988 | Fitzpatrick | 482/103 |
| 4,728,102 | 3/1988 | Pauls | 482/909 X |
| 4,765,315 | 8/1988 | Krukowski | 482/5 X |
| 4,765,613 | 8/1988 | Voris | 482/5 |
| 4,817,940 | 4/1989 | Shaw et al. | 482/9 |
| 4,826,154 | 5/1989 | Askonen | 482/101 |
| 4,979,733 | 12/1990 | Prud'Hon | 482/8 X |
| 4,989,861 | 2/1991 | Halpern . | |

OTHER PUBLICATIONS

Marcy Brochure for the Marcy EM/1 Fastral, 1987.

Universal Brochure for The Power-Pak, Date Unknown.

Maximus Brochure For the Bodyshaper, Date Unknown.

Soloflex Brochure, Date Unknown.

*Primary Examiner*—Robert Bahr

[57] ABSTRACT

The present invention provides a flexible line guidance and tension measuring device for use on an exercise apparatus to guide a flexible line from a resistance mechanism to an exercise member and measure tension in the flexible line. A fixed member is operatively secured to the exercise apparatus, and a movable member is movably mounted to the fixed member. The flexible line passes over a load bearing pulley rotatably mounted on the movable member. Tension in the flexible line causes the movable member to move relative to the fixed member, and an incremental deflection measuring means measures the relative movement.

15 Claims, 18 Drawing Sheets

FLEXIBLE LINE GUIDANCE AND TENSION MEASURING DEVICE

This is a continuation-in-part of U.S. patent application Ser. No. 07/791,073 filed Nov. 12, 1991, now U.S. Pat. No. 5,195,937, and of U.S. patent application Ser. No. 07/769,549 filed Oct. 1, 1991, now pending and of U.S. patent application Ser. No. 07/500,517, filed Mar. 28, 1990, now U.S. Pat. No. 5,090,694, issued Feb. 25, 1992.

FIELD OF THE INVENTION

The present invention relates generally to exercise equipment that provides resistance to movement through one or more flexible lines, and more particularly, to a device for guiding such flexible line(s) from a resistance mechanism to exercise member(s) and for measuring the exercise load as a function of the tension in the flexible line(s).

BACKGROUND OF THE INVENTION

Those skilled in the art will recognize the desirability of providing isokinetic resistance to movement for exercise purposes, and that flexible lines may be used to provide such resistance. Also, those skilled in the art will recognize the desirability of providing a single unit that facilitates a full body workout. The present invention involves an exercise unit that is capable of providing isokinetic resistance through flexible lines relative to a person performing pullovers, pull downs, chest crosses, butterflies (with the arms either up or down), chest presses, bicep curls, leg curls, leg extensions, squats, etc. The present invention facilitates a wide range of exercises that depend upon a single isokinetic resistance mechanism. The present invention not only guides one or more flexible lines from a resistance mechanism to one or more exercise members; it also measures the exercise load as a function of the tension in the flexible line(s) without impacting the exercise load.

SUMMARY OF THE INVENTION

The present invention is directed toward a flexible line guidance and tension measuring device for use on an exercise apparatus to guide a flexible line from a resistance mechanism to an exercise member and measure tension in the flexible line. According to one embodiment, the present invention includes a fixed member operatively connected to the exercise apparatus. A movable member is movably mounted to the fixed member in such a manner that the movable member is movable among a plurality of positions relative to an operating surface on the fixed member. A load bearing pulley is rotatably mounted on the movable member, and the flexible line passes over the pulley. Any tension in the flexible line tends to move the movable member from one position to another relative to the operating surface on the fixed member, thereby defining an incremental deflection that is measured by means operatively mounted to the movable member.

In operation, the present invention provides a device with the ability to perform the functions of line guidance and line tension measurement. The invention is capable of guiding several lines, from a number of exercise elements to the isokinetic resistance mechanism. The lines may be guided t the isokinetic resistance mechanism from any direction, each being guided independent of the other lines. In addition, the invention is able to measure the tension in whichever of the lines is being used, without changing the tension in that line or any of the other lines. Also, the invention performs the guidance and tension measuring functions independently, such that the guidance function does not alter the tension in the line, and the measuring function does not interfere with the movement of any of the lines relative to the invention.

Another advantage of the present invention is that one simple device is capable of guiding several lines arriving from multiple directions to the isokinetic resistance mechanism, and to measure the tension in whichever line is being used. Because only one device is used, the number of parts required for the exercise apparatus is reduced, and the exercise apparatus as a whole is simpler and more efficient.

In a preferred embodiment, the flexible line guidance and tension measuring device includes:

(a) a fixed member operatively secured to the exercise apparatus and having an operating surface;

(b) a pivoting member pivotally mounted to said fixed member and having a leading surface, a trailing surface, and a sliding surface, wherein said leading surface is proximate to said operating surface on said fixed member;

(c) a sliding member slidably secured relative to said sliding surface on said pivoting member, wherein said sliding member has a first end surface and a second, opposite, end surface, and said first end surface extends beyond said leading surface of said pivoting member such that said first end surface contacts said operating surface of said fixed member, upon movement of said movable member toward said fixed member;

(d) a plurality of load bearing pulleys, each load bearing pulley rotatably mounted on said pivoting member, wherein a respective flexible line passes over each said pulley in such a manner that tension in the respective flexible line pulls said pivoting member toward said fixed member, thereby forcing said first end surface of said sliding member against said operating surface; and (e) a strain gauge having a first end mounted to said trailing surface of said pivoting member, and a second end mounted to said second end surface of said sliding member, whereby a measurable strain is induced on said strain gauge by whichever of said plurality of flexible lines is in greatest tension.

The device may further include two intermediate guide pulleys to guide the flexible lines from the load bearing pulleys to the isokinetic resistance mechanism, and two distal guide pulleys, to guide the flexible lines from the load bearing pulleys to various exercise members. Should more or less lines be desired, the design of the device may be modified using various combinations of load bearing pulleys, intermediate guide pulleys and distal guide pulleys.

The device operates on the principle that tension in a flexible line passing through the device induces a force on a load bearing pulley and consequently pulls the pivoting member toward the fixed member. The sliding member is forced into contact with the operating surface on the fixed member, and the sliding member is induced to slide along the sliding surface on the pivoting member. The strain gauge, which extends between the sliding member and the pivoting member, then measures the strain that is induced by the movement of the sliding member relative to the pivoting member. Finally, the resulting signal from the strain gauge is routed to an output device, which converts the signal received from the strain gauge into a value representative of the force applied by the user on the exercise member.

The present invention may be incorporated into an exercise unit which has a wide range of upper and lower body conditioning exercises. Such an exercise unit may comprise:

(a) a positionable bench;

(b) a horizontal member extending below the bench;

(c) a vertical member extending upwardly from a first end of the horizontal member;

(d) a loading device operable to apply a drag on a moveable element forming part of the loading device, the loading device situated on said horizontal member or vertical member, the loading device comprising a rotatable centrifugal force sensitive force generating brake member that provides a resistive force proportional to the speed of rotation of the rotatable member; and (e) an exercise operable element connected to the loading device by a flexible line, the line being mounted such that upon movement of the line away from the loading device, the moveable element of the loading device is moved and the line is loaded.

The loading device is an isokinetic resistance mechanism which is positioned below the bench, and is of a small enough size so that it does not protrude excessively out of either side. It is an isokinetic exercise unit in that the resistive force increases to match the applied force or speed. The unit provides a safe form of exercise since there are no weights that will fall or cause a strain on muscles, no elastic cords or gaskets which snap back and the resistance force will stop as soon as the applied force is stopped. In this manner, an individual may exercise without fear of injury and may stop the exercise in midstroke. As muscles are fatigued during the exercise, the exercise regime can continue at a slower pace and the loads will automatically be reduced.

DESCRIPTION OF A PREFERRED EMBODIMENT

The exercise apparatus comprises a loading or force generating assembly which will generate isokinetic resistive forces for loading muscles that are being used to move (extend) cords or lines. The exercise apparatus is made so that the direction of force to be applied by the person performing the exercise can be changed to exercise different muscles and to provide force directions that are selected for an overall upper and lower body exercise program.

In order to serve as a functioning exerciser, the isokinetic device has to be capable of providing resistive forces that are adequate for a wide range of loads, accommodate a number of different levels of exercise and also permit the user to vary the forces across a range of exercises from a warm-up period to a full load period.

Figure 1:
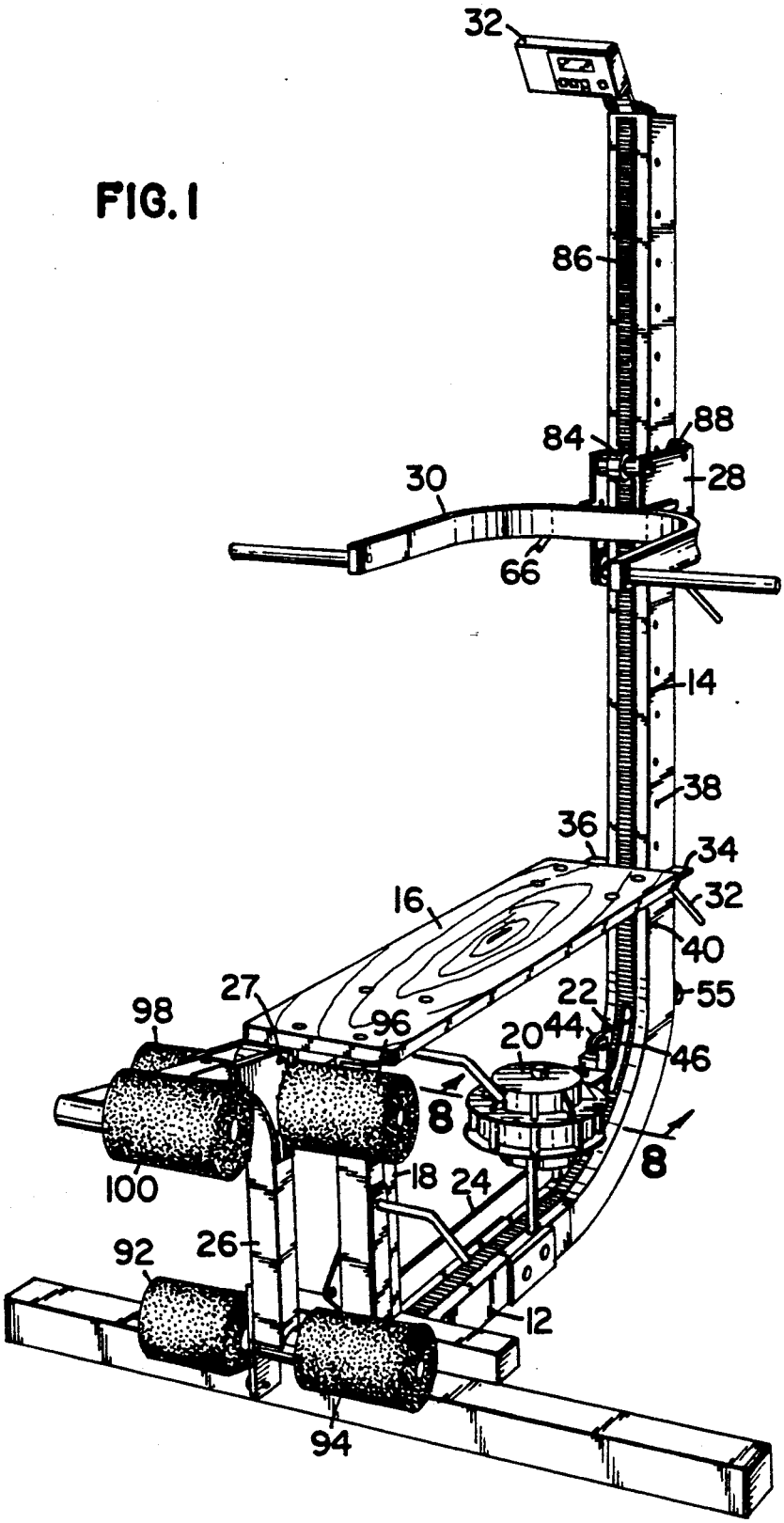
FIG. 1 is a perspective view of the multi exercise unit according to the present invention.

Referring to FIG. 1, the exercise unit of the present invention is shown as 10. The exercise unit has a horizontal T-member 12 and a vertical member 14. The shape of the horizontal member 12 may be a T as shown or could also be a Y or other configuration which would provide a stable base. Furthermore, the horizontal member 12 and the vertical member 14 are shown as one piece. However, this could be a two piece configuration. Bench 16 is shown attached to vertical member 14, and resting on support member 18. Support member 18 extends from horizontal member 12 and may or may not be removable from horizontal member 12. The isokinetic device 20 is shown secured to the horizontal member 12 with lines or cords 22 and 24 extending therefrom. Cord 24 extends away from the vertical member and is attached to L-shaped exercise element 26, which pivots about point 27. This exercise element 26 is generally used for lower body conditioning such as leg extensions and leg curls. Pads 92, 94, 96, 98 and 100 are for the user's comfort during exercise. The L-shaped exercise element 26 may or may not be attached to the exercise apparatus 10. It may be removed when it is not in use. Cord 22 extends through vertical member 14 and upward on the vertical member 14 as shown in FIGS. 5-7. Line 22 is attached to carriage 28. The carriage 28 travels up and down vertical member 14 and is shown in more detail in FIGS. 4 and 10. The carriage 28 can be any type of sliding configuration which allows the transfer of resistance from the isokinetic device 20 to an exercise element. Bench press exercise element 30 is shown attached to carriage 28. This exercise element 30 may be used for bench presses or may also be used for squats, with the bench 16 removed. Electronic display readout 32 provides the user with a multitude of readouts including number of repetitions, the measured force, the maximum force exerted, as well as other useful information.

Figure 2:
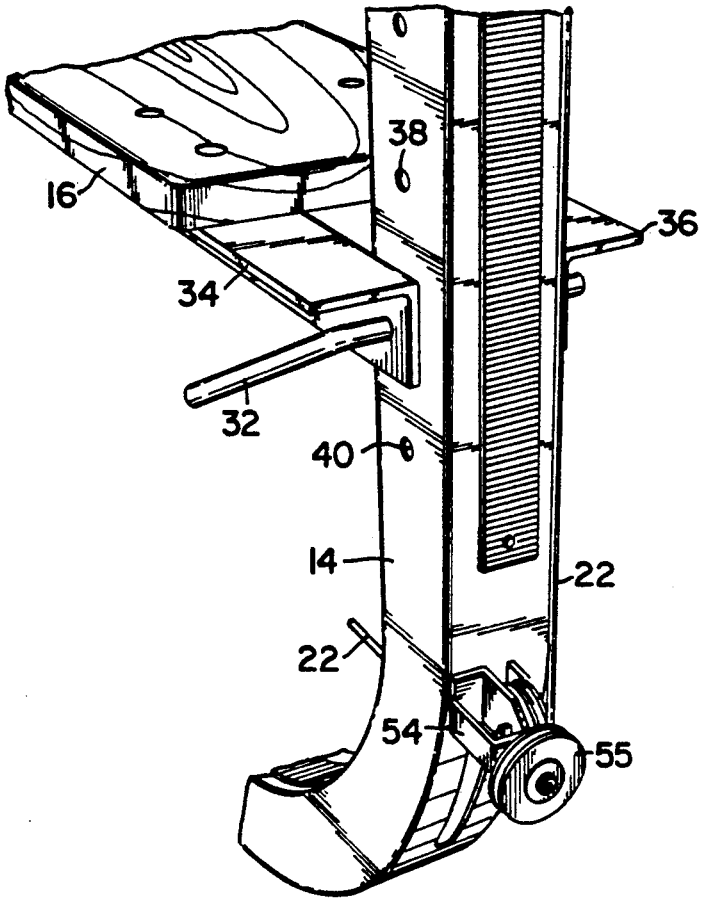
FIG. 2 is a perspective view of a portion of the rear of the multi exercise unit of FIG. 1.
Figure 3:
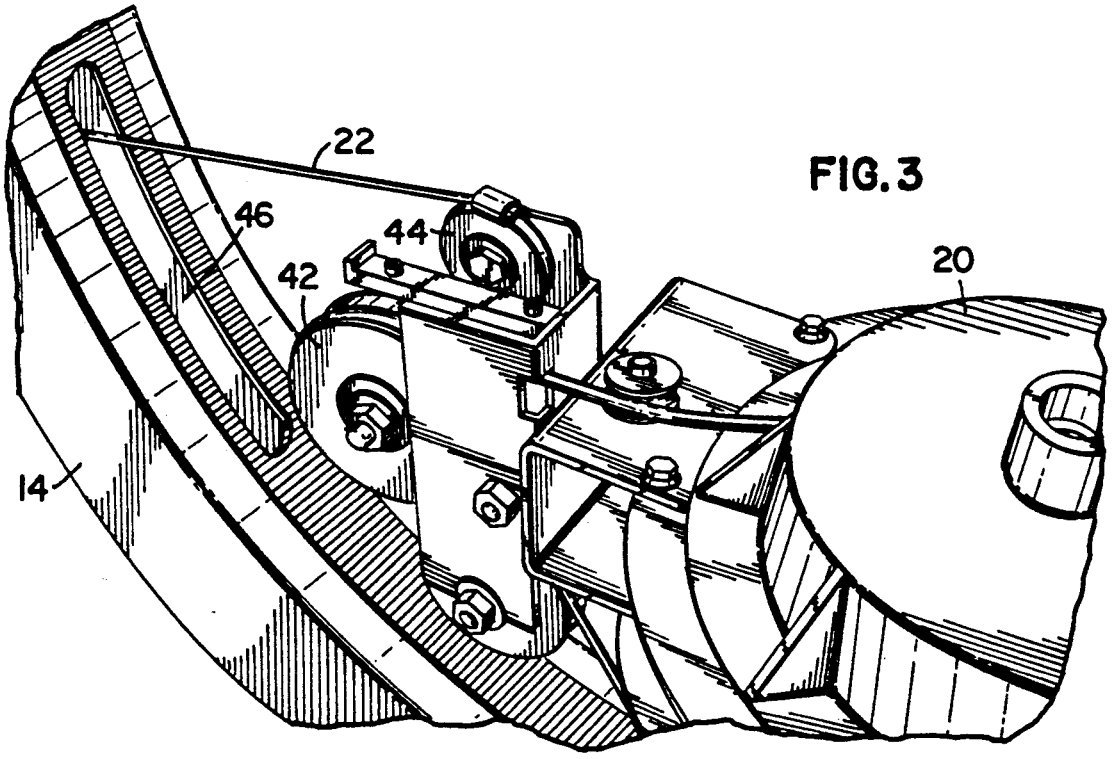
FIG. 3 is a perspective view of a portion of the isokinetic device of the multi exercise unit of FIG. 1.

FIGS. 2 and 3 show the isokinetic device 20 and the attachment of bench 16 in more detail. As is shown in FIG. 2, bench 16 is attached to vertical member 14 by pin 32 extending through brackets 34 and 36 which are attached to bench 16. The pin 32 extends through apertures in brackets 34 and 36 and apertures in the vertical member 14. It is also desirable to be able to change the elevation of the bench 16 for various exercises including sit-ups. To accommodate this, the bench 16 may be raised or lowered, with the pin 32 being inserted into apertures 38 or 40 respectively. In this manner, inverted sit-ups are possible. Referring to FIG. 3, cord 22 extends out of loading device 20, through two circular pulleys 42 and 44 and extends through aperture 46 which is in vertical member 14. Cord 22 may also extend up vertical member 14 on the inside, but for aesthetic reasons as well as to move the cords out of the user's way, it is preferred to run the cords on the outside of vertical member 14.

Figure 4:
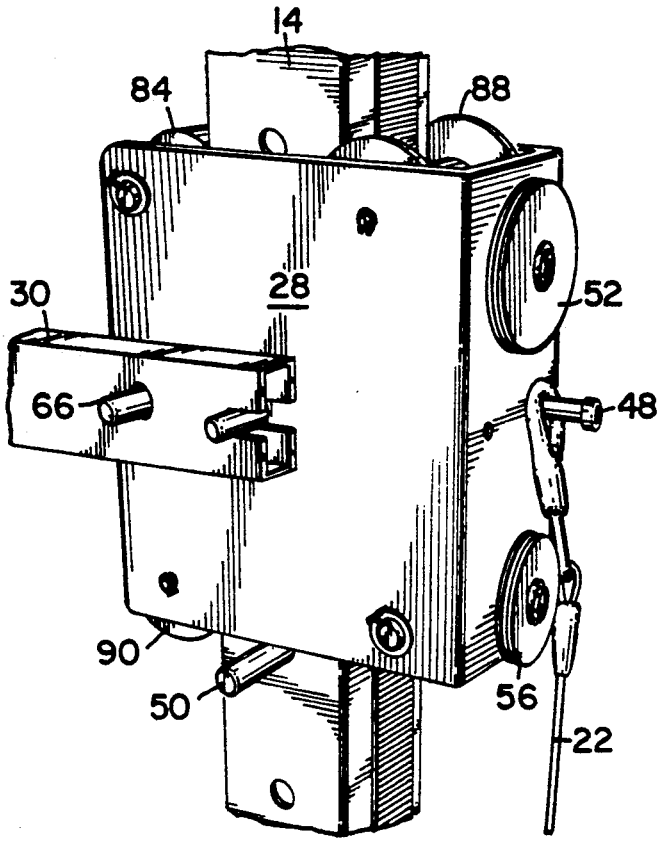
FIG. 4 is a perspective view of the carriage of the present invention.
Figure 5:
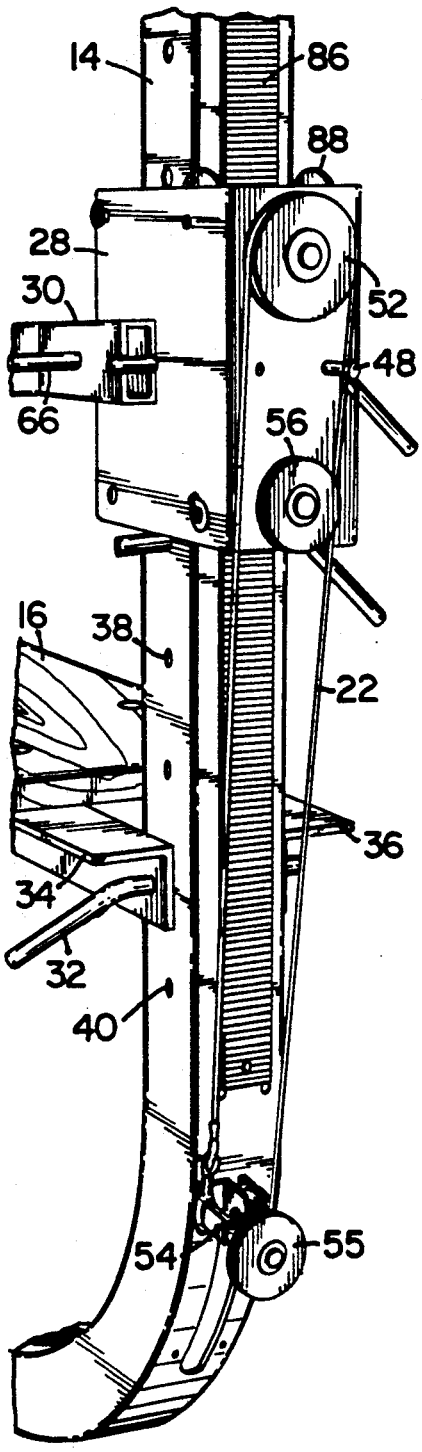
FIGS. 5, 6 and 7 are perspective views of different resistive settings for the isokinetic device of the present invention.
Figure 6:
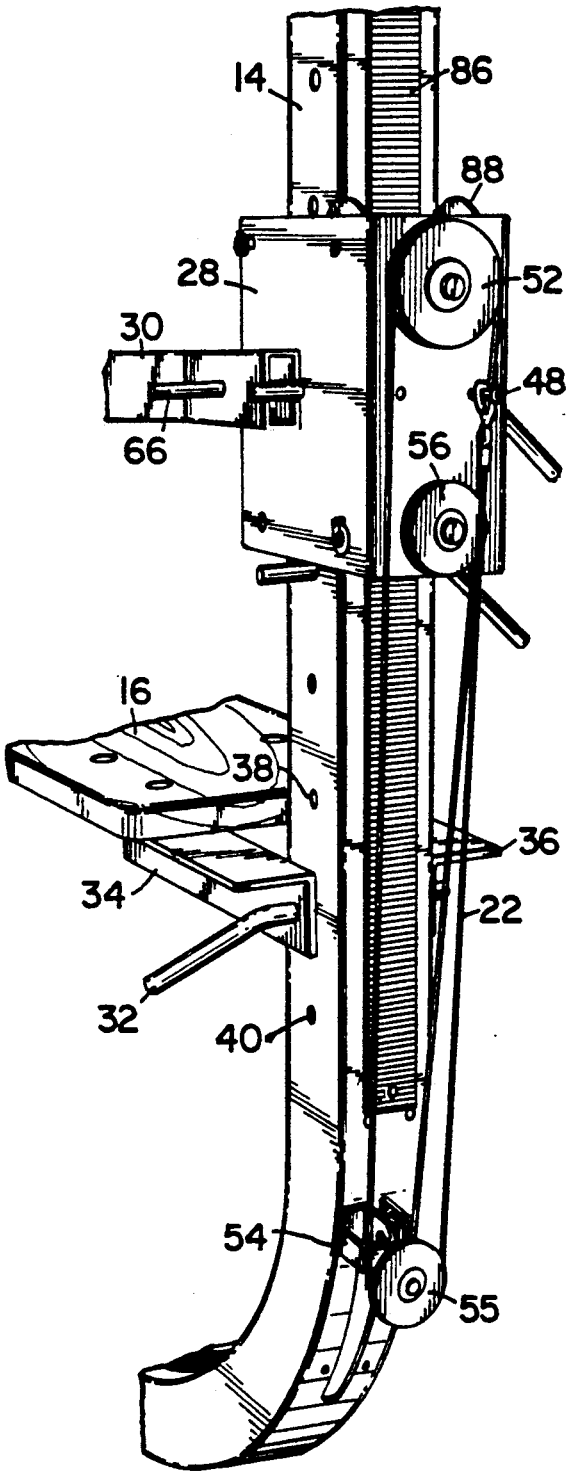
Figure 7:
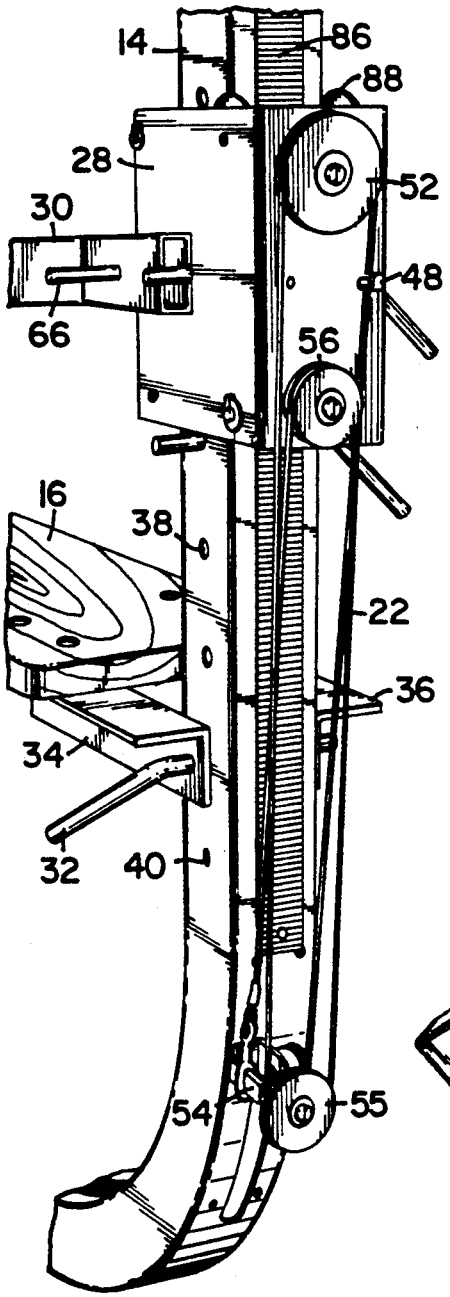

FIGS. 4, 5, 6, and 7 show cord 22 adjusted such that varying degrees of resistance are achieved. In the preferred embodiment of the present invention there are four resistance levels for exercises involving carriage 28. The resistance provided by isokinetic device 20 is a function of the speed of the line moving out of isokinetic device 20. This is further explained in FIGS. 14-17, wherein the resistance mechanism is described in detail. The preferred embodiment of the present invention has four levels of resistance for carriage 28. The first, shown at FIG. 4, is a low resistance. Line 22 is shown attached to pin 48. The carriage rests on pin 50. As the bench press element 30 is pushed in an upward direction, carriage 28 travels in a vertical plane on vertical member 14 which thus pulls line 22 out of isokinetic device 20. When the carriage 28 reaches its maximum height along vertical members 14, and when the down stroke begins, line 22 is recoiled into isokinetic device 20, with the only resistance at that time being the weight of carriage 28. Thus, the present exercise unit provides resistance for the concentric portion of the exercise, but provides little to no resistance on the eccentric portion of the exerciser (just the weight of the carriage), thereby reducing muscle injuries which often occur as a heavy load is being lowered during eccentric contractions. A further advantage over the prior art is that carriage 28 travels vertically along vertical member 14, thus during bench presses or squats, bar 30 also travels in a vertical motion. This feature is advantageous over other home exercise units which rely on a pivot point along the vertical member, and also rely on some sort of spring, shock cord or rubber gasket. In these prior art home devices, when a bar similar to bar 30 is moved in an upward direction, the bar not only moves upwardly but also moves closer to vertical member 14, thus resulting in an arcing motion. This is due to a pivot point located on or adjacent the vertical member. In the present invention, this arcing motion is avoided with the carriage 28 moving vertically up and down the vertical member 14. Thus, a fluid uni-directional stroke results, rather than the bar moving upward and angularly towards the vertical member. This upward and angular motion is undesirable for bench presses and squats in that when the individual exercising reaches maximum extension, it is a very difficult motion for the exercising muscles to perform when they are being displaced in an angular motion. Thus, the present invention is desirable over the prior art for this feature as well as the other features outlined herein.

FIGS. 5, 6 and 7 show alternative levels of resistance corresponding to medium, heavy and professional resistance respectively. As is noted in FIG. 5, line 22 travels around pulley 52 and attaches to bracket 54. Thus, as carriage 28 travels up vertical member 14, line 22 extends outwardly at a speed approximately twice that of FIG. 4. This provides greater resistance.

FIG. 6, shows line 22 extending around pulley 52, around pulley 55 and secured to pin 48. This provides a higher degree of resistance than that shown in FIG. 5. As is obvious from the configuration, there is a greater amount of line 22 being pulled out of isokinetic device 20 as carriage 28 travels up vertical member 14. The highest degree of the resistance of the preferred embodiment is shown at FIG. 7. Line 22 extends around pulley 52, pulley 55, pulley 56, and locks onto bracket 54. In this configuration, line 22 travels the fastest as it leaves isokinetic device 20. As is obvious from the configurations, there could be greater or fewer levels of resistance.

An advantage of the present invention's isokinetic device over the prior devices is the wide window of resistance which is provided with each level. Depending on the individual who uses the exercise apparatus, each of the four levels generally provides a wide enough window of resistance for all exercises. Thus, it should not be necessary to adjust to a different resistance level when, for example, switching from a bench press to a lat pull. This differs significantly from the prior art, which requires a different size shock cord or a different amount of weight for each exercise. Thus, the present invention allows the user to preset the resistance mechanism, and go through all of the exercises without the tedious and often confusing regime of switching shock cords, spring mechanisms, elastic bands, or weights for each different exercise.

Figure 10:
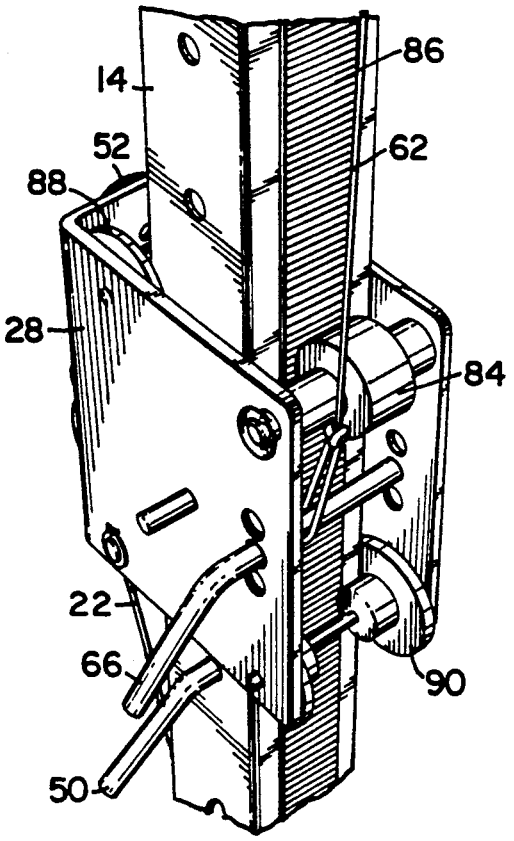
FIG. 10 is a perspective view of the carriage of the present invention.
Figure 8:
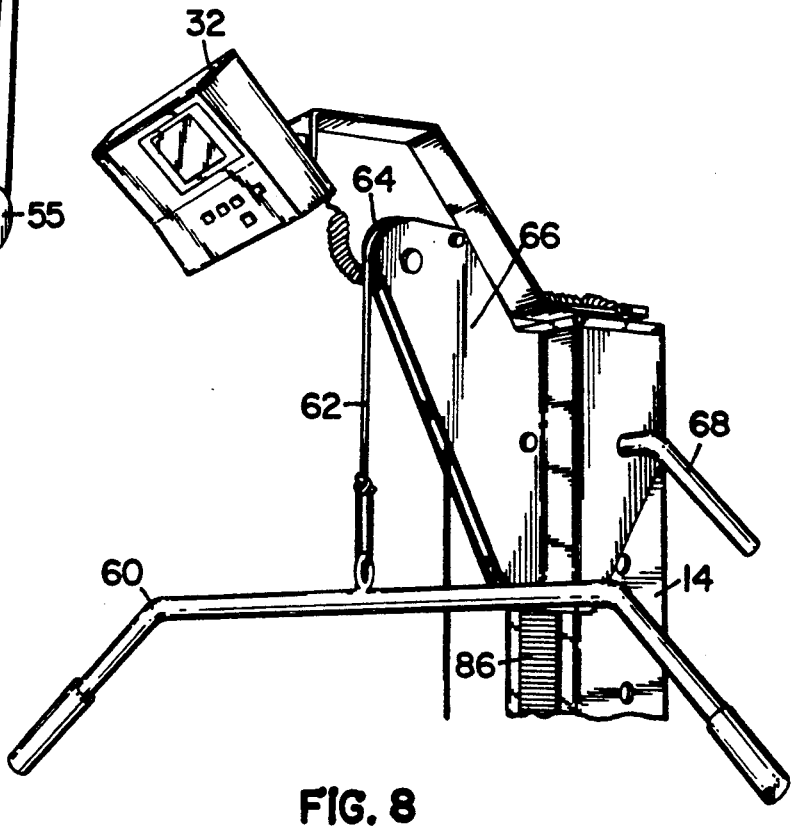
FIG. 8 is a perspective view of a lat pull attachment of the present invention.

FIG. 8 shows bar 60 which is connected to line 62 which extends over pulley 64 and down the back of vertical member 14 until line 62 attaches to pin 68 as shown in FIG. 10. Bar 60 is generally configured for lat pulls. The user sits on bench 16, grasps bar 60 and pulls it in a downward fashion. Line 62, being attached to carriage 28, lifts carriage 28 as bar 60 is pulled downward. The resistance of carriage 28 is set as described above. When not using exercises involving bar 60, bracket 66 may be removed from vertical member 14 by removing pin 68.

Figure 18:
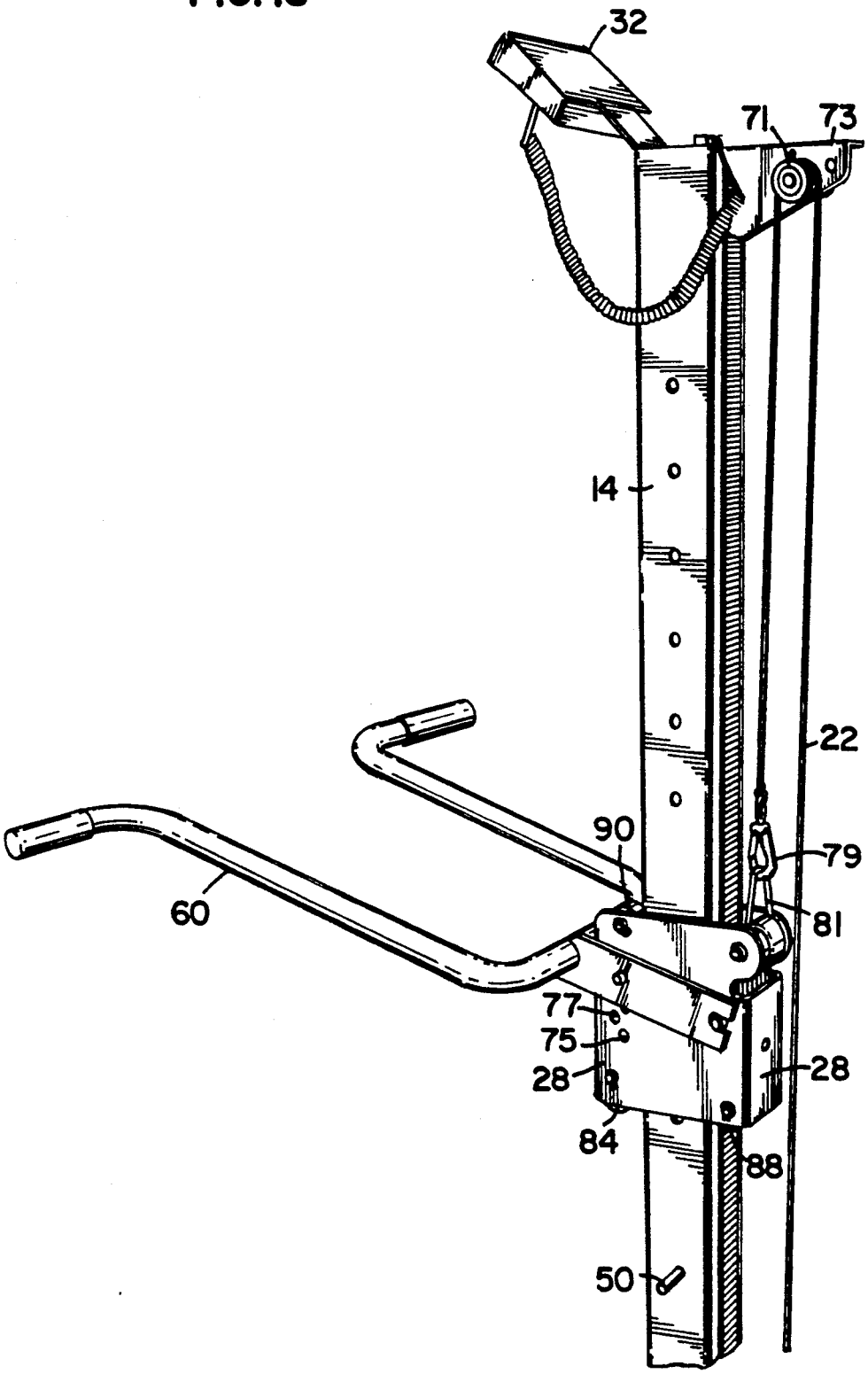
FIG. 18 is a perspective view of a preferred embodiment of a lat pull attachment.
Figure 19:
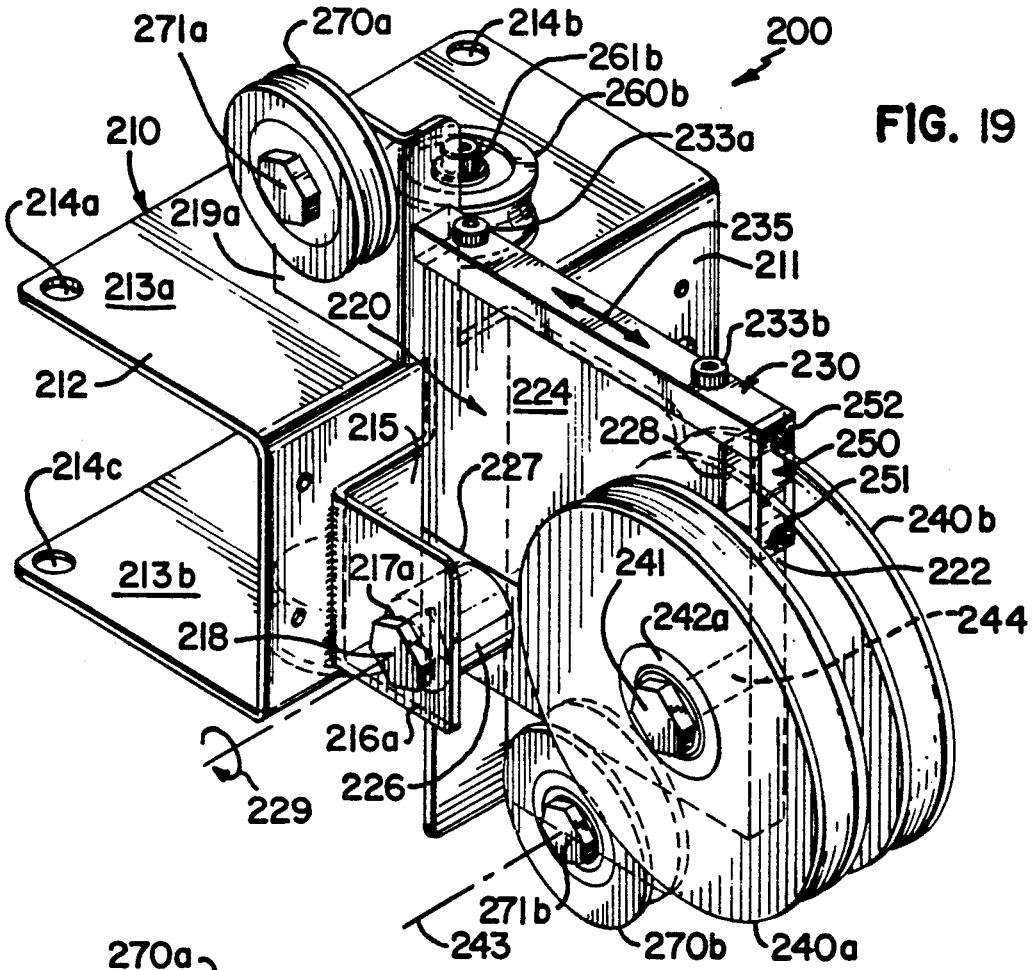
FIG. 19 is a perspective view of a preferred embodiment of a flexible line guidance and tension measuring device according to the principles of the present invention.
Figure 20:
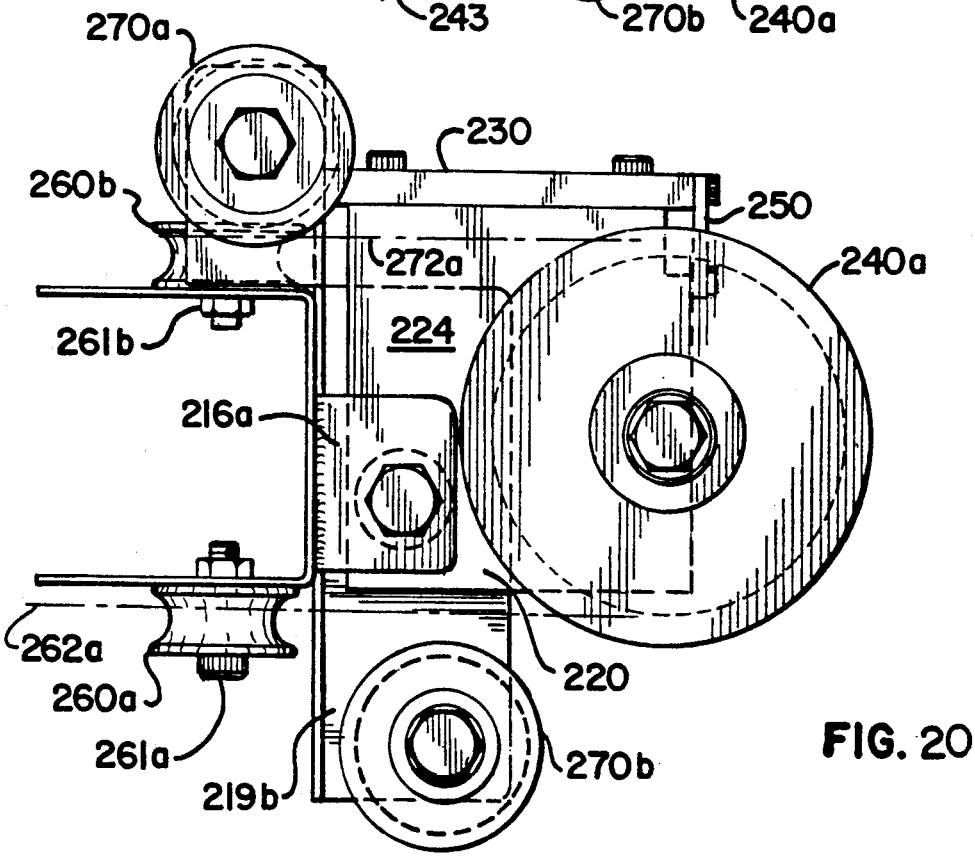
FIG. 20 is a left side view of the flexible line guidance and tension measuring device shown in FIG. 19.
Figure 21:
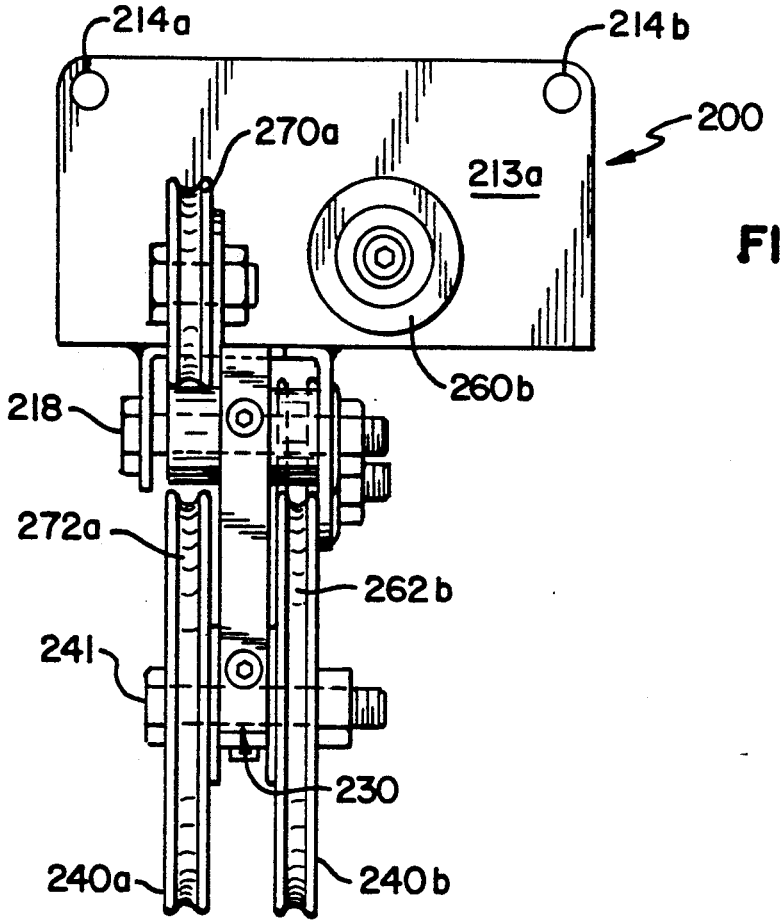
FIG. 21 is a top view of the flexible line guidance and tension measuring device shown in FIG. 19.
Figure 22:
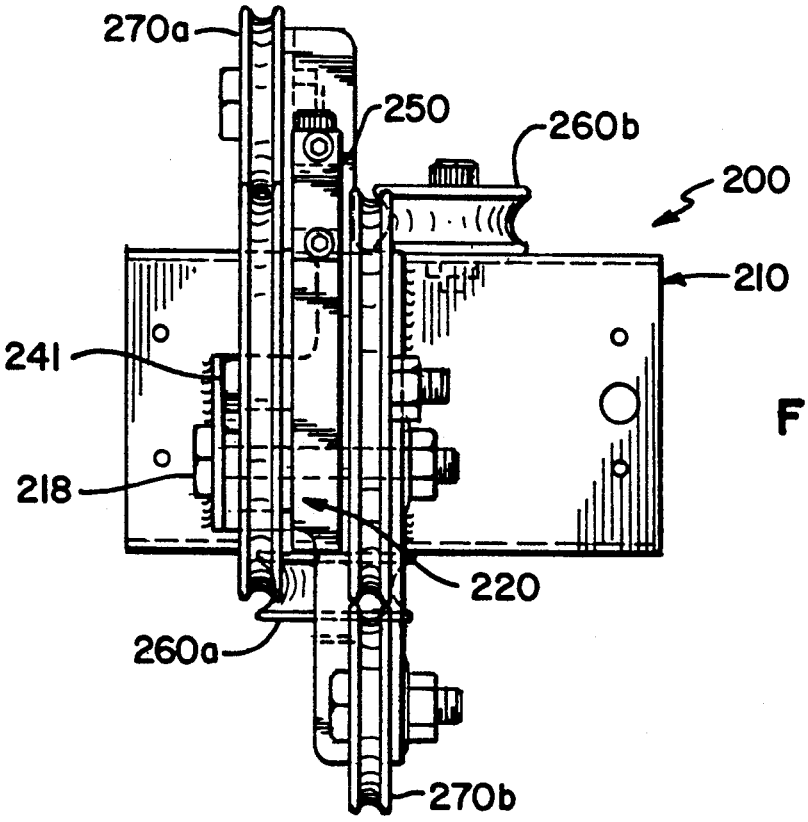
FIG. 22 is a front view of the flexible line guidance and tension measuring device shown in FIG. 19.
Figure 23:
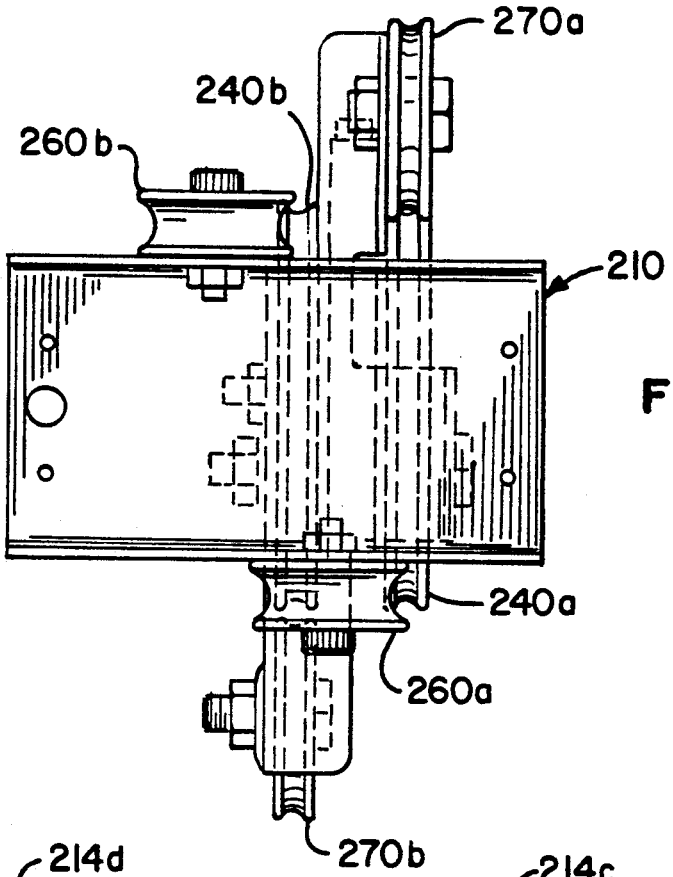
FIG. 23 is a back view of the flexible line guidance and tension measuring device shown in FIG. 19.
Figure 24:
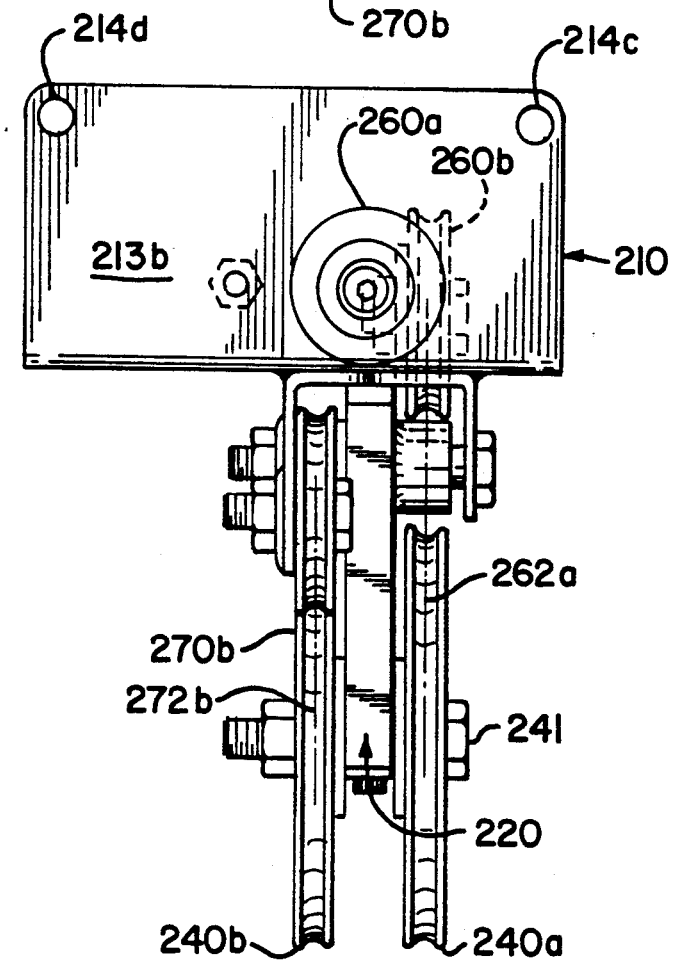
FIG. 24 is a bottom view of the flexible line guidance and tension measuring device shown in FIG. 19.
Figure 25:
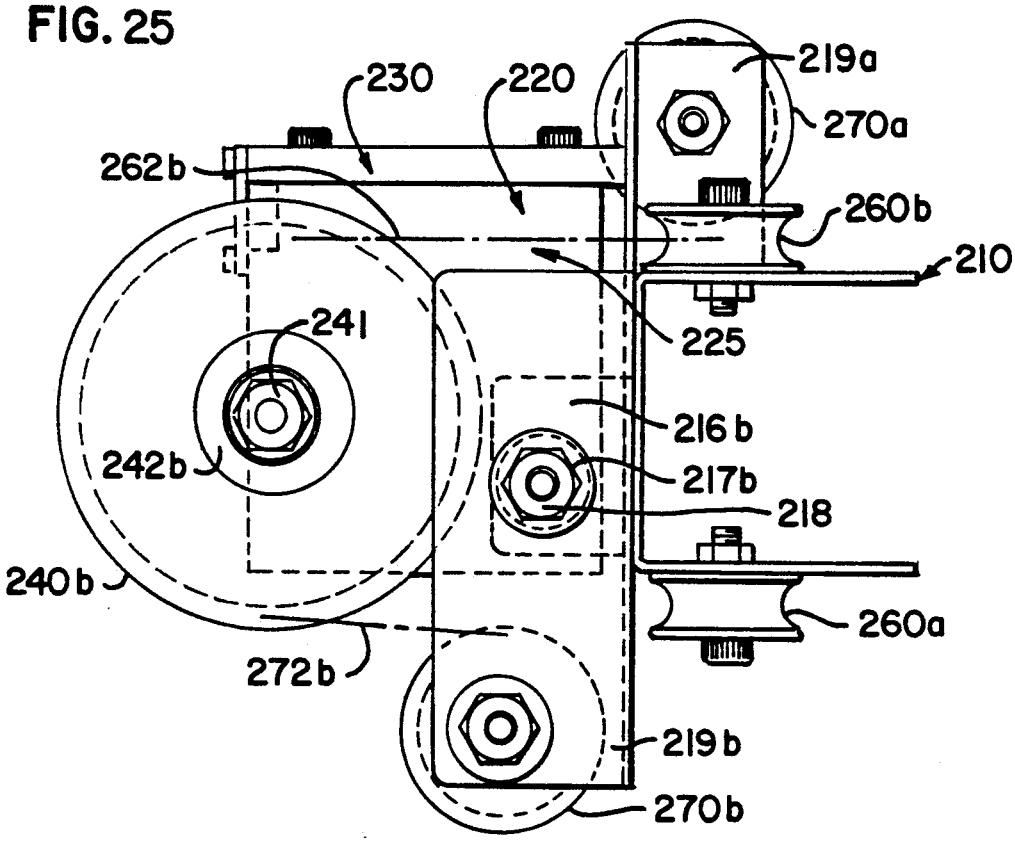
FIG. 25 is a right side view of the flexible line guidance and tension measuring device shown in FIG. 19
Figure 26:
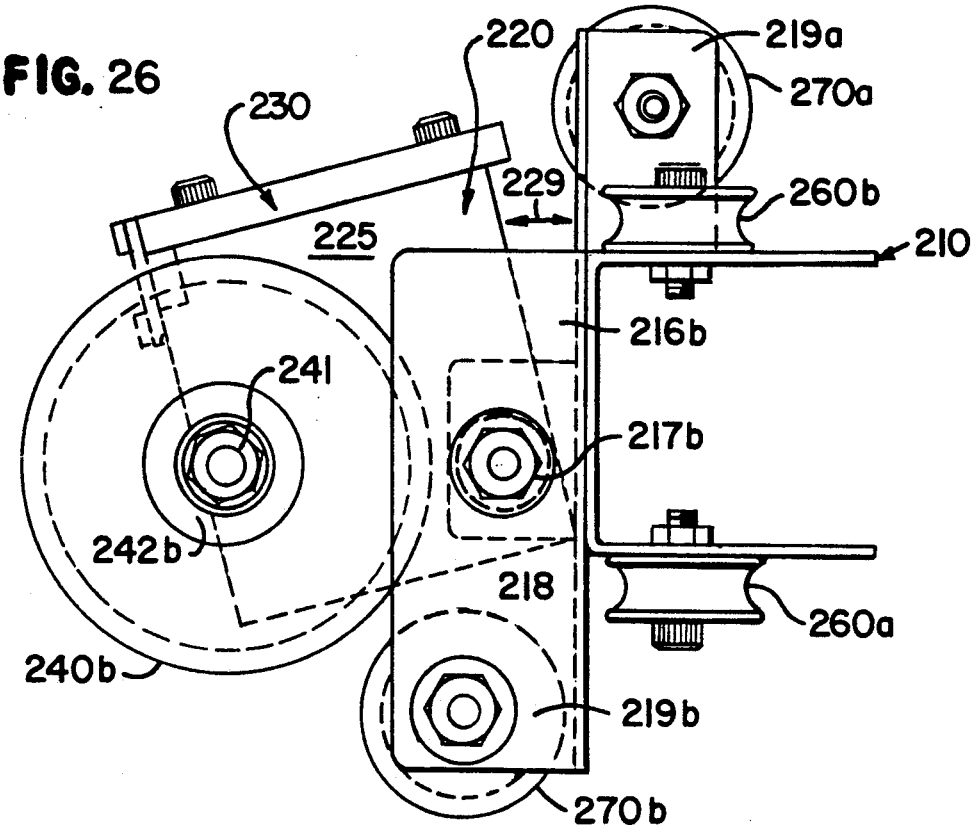
FIG. 26 is a right side view of the flexible line guidance and tension measuring device shown in FIG. 19, with the pivoting member shown pivoted away from the operating surface of the fixed member.

FIG. 18 illustrates a preferred embodiment of a lat pull configuration. Carriage 28 is lifted off the end of vertical member 14, flipped over and put back on vertical member 14 such that roller bearing 84 is positioned where caster 90 was previously positioned, i.e., the closest bearing or caster to bench 16. The carriage 28 is lowered to rest on pin 50. Pulley 71 is positioned atop vertical member 14 with support 73 extending rearwardly and pulley 71 positioned to receive line 22. Line 22 is placed around pulley 71, extended down and attached to carriage 28 via clip 79 to loop 81. Carriage 28 is thereafter suspended from line 22 and pin 50 may be removed. Carriage 28 may then be lifted to a comfortable height for the user sitting on bench 16. Carriage 28 remains in place as a result of cord 62 and resistance device 20. The user then proceeds to pull the carriage 28 down and return carriage 28 to its starting position. This exercise may be repeated over and over to exercise various muscles. Bar 60 may also be tilted in a more compatible position by adjusting pin 50 through apertures 75 and 77. The resistance is adjusted in a manner previously described, i.e. extending line 22 through a series of pulleys. When the user is finished with lat pulls, the carriage 28 is returned to its previous position by lifting carriage 28 over vertical member 14 and reversing the carriage 28 so it may be used for bench presses, etc.

Figure 9:
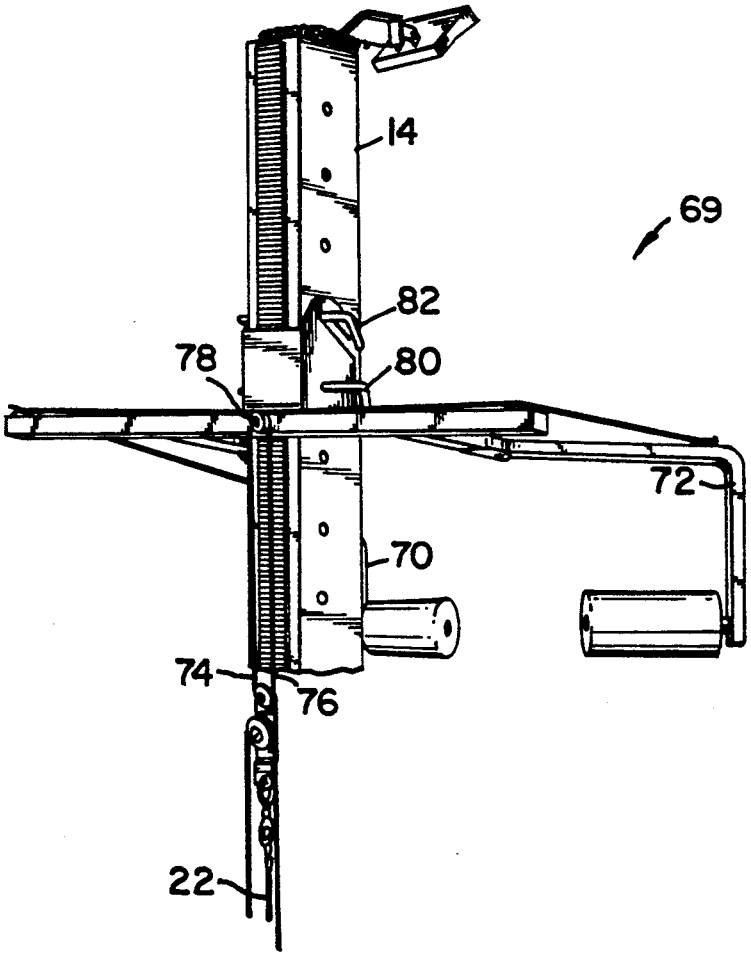
FIG. 9 is a perspective view of a butterfly attachment of the present invention.

FIG. 9 shows a butterfly attachment 69. The user sits on bench 16, grasps the outside of bars 70 and 72 and squeezes bars 70 and 72 together. Line 22, shown at the bottom, is connected to lines 74 and 76, which travel through pulley apparatus 78, and are connected to bars 70 and 72. As bars 70 and 72 are moved together, lines 74 and 76 pull on line 22, thus creating resistance as described previously. Butterfly apparatus 69 is attached to vertical member 14 via pin 80. The pivot axis of the apparatus 69 may be one or more pivot points. Carriage 28 is moved above butterfly apparatus 69 such that it does not interfere with line 22. Pin 82 is inserted in apertures in vertical member 14 wherein carriage 28 resists upon pin 82.

FIG. 10 shows carriage 28 in greater detail. Roller bearing 84 is required in that as line 22 pulls carriage 28 down, as the user pulls the carriage upward, a great deal of torque is applied to carriage 28 and a smooth, loaded bearing is required in order for the carriage 28 to roll freely. Another roller bearing, identical to bearing 82, is hidden from a view in the back with just the securing pin 85 showing. The roller bearings are generally made of solid metal, and thus provide for a smooth movement of carriage 28 as it moves up and down vertical member 14. There is significant force applied at the interface of the roller bearings and vertical member 14 as the carriage 28 moves up and down, thus it is preferred to have some type of bearing race (hardened steel strip or low friction tape) on vertical member 14 as shown as 86. Casters 88 and 90 prevent lateral motion of the carriage as it travels up and down vertical member 14. The wide flange of casters 88 and 90 resist lateral motion of the carriage 28.

Figure 11:
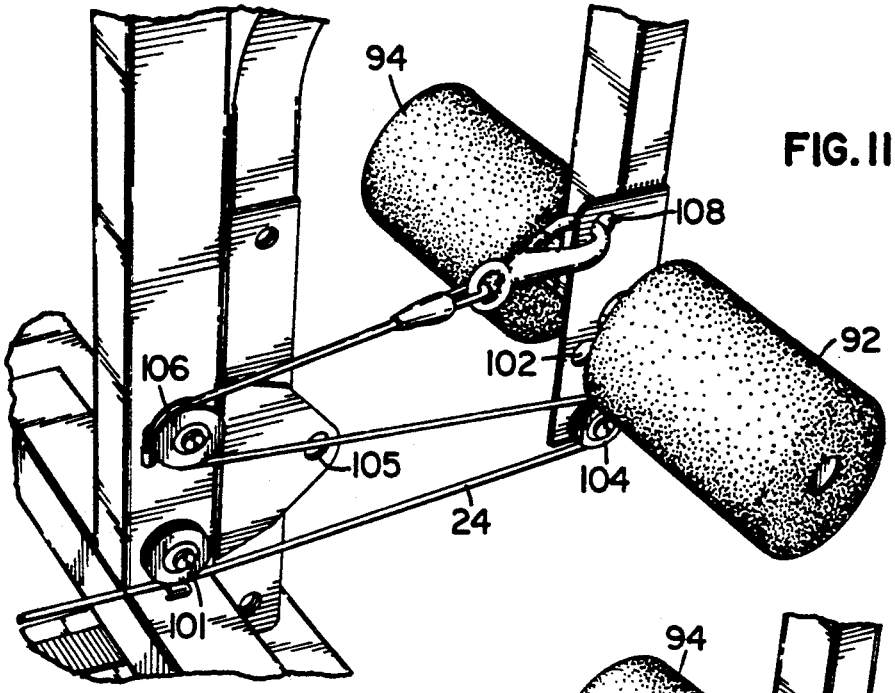
FIGS. 11-13 are perspective views of different resistive settings for the isokinetic device of the present invention.
Figure 12:
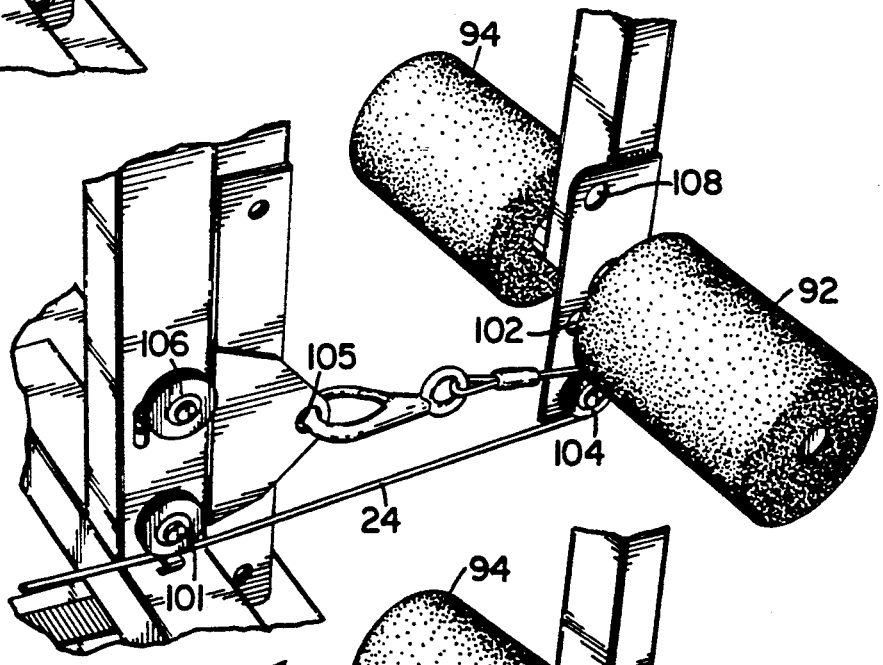
Figure 13:
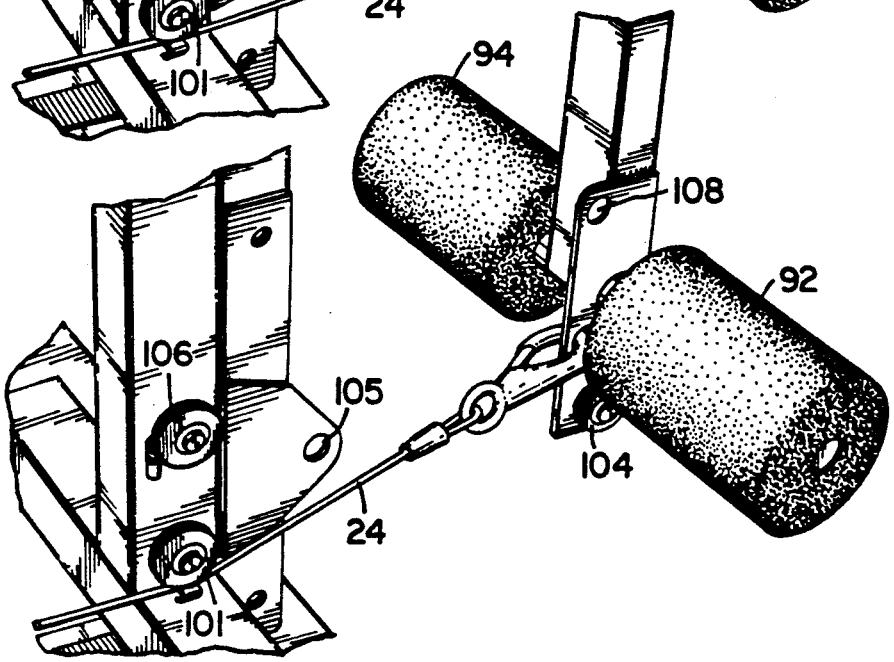

FIGS. 11, 12 and 13 show the various resistance hookups for the L-shaped attachment 26. Referring back to FIG. 1, the lower body attachment may be used in a variety of manners. One manner is for an individual to lay flat on his or her stomach on bench 16, and hook the back portion of his or her ankles on pads 92 and 94. The legs are then pulled upward such that the feet are approaching the individual's head (leg flexions), and then the legs are lowered back to the resting position. Another exercise involves the individual sitting on bench 16 facing away from vertical member 14. The front portion of the individual's ankles are hooked under pads 92 and 94 and the user extends his or her legs such that they are in an approximate linear plane with bench 16. Pads 96 and 98 provide cushion for the user's legs during these exercises. Yet another exercise has the user crouch and put his or her elbow on bench 16 while facing away from vertical member 14. The user grabs pad 100, and performs arm curls, thereby moving the L-shaped attachment 26.

An alternative embodiment for the lower body attachment is to not include the L-portion containing pad 100. It is often uncomfortable for certain individuals to lie flat on their stomach (e.g., pregnant women) thus leg flexions are preformed in a standing position. In the alternative embodiment, the user would perform leg flexions standing adjacent the rear portion of bench 16. The user hooks his/her leg between pads 92 or 94 and apparatus 10 and performs leg lifts from a standing position. The exerciser may grasp bench 16 for balance during this exercise. Arm curls may still be performed without the L-portion. The exerciser would place his/her elbow on pads 96 or 98, grasp pad 94 or 92 and perform arm curls. Thus, the alternative lower body embodiment has all of the advantages of the first embodiment.

The resistance for all of these exercises may be adjusted as shown in FIGS. 11-13. FIG. 13 shows the least resistance wherein line 24 is attached to element 26 at aperture 102. As described previously, the amount of resistance is a function of the speed of line movement out of isokinetic device 20. Thus, as line 24 is guided back and forth over more pulleys, the speed of line 24 increases as L-shaped attachment is moved. FIG. 12 represents a middle level of resistance and has line 24 wrapping around pulley 104 and attaching at eyelet 105. The third or highest level of resistance is shown in FIG. 11 wherein line 24 extends around pulleys 104 and 106, and attaches at eyelet 108. Thus, as the L-shaped element 26 is moved about pivot point 27, as shown in FIG. 1, line 24 is pulled out of isokinetic device 20.

Figure 15:
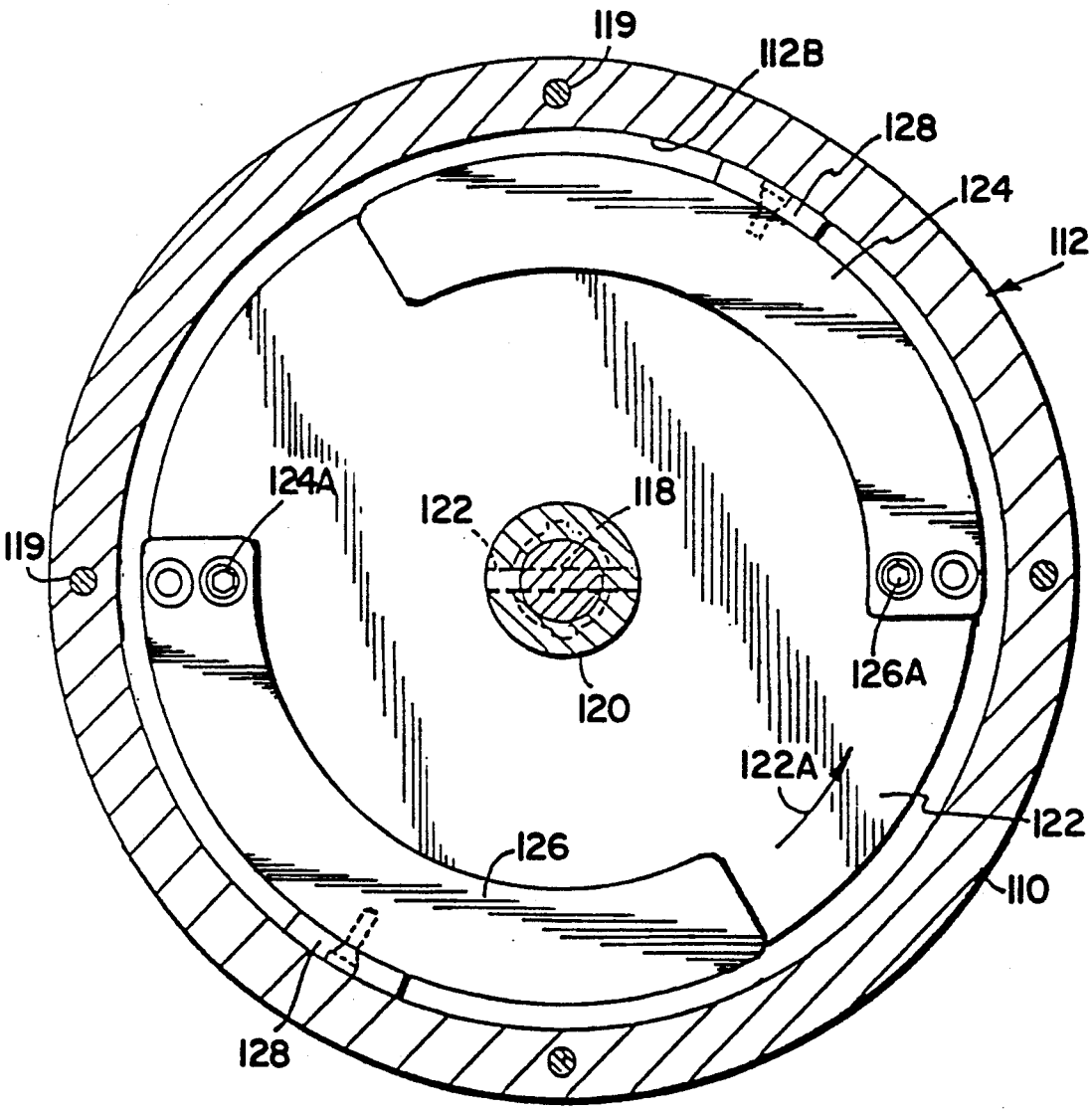
FIG. 15 is a sectional view taken generally on line 8—8 in FIG. 14.
Figure 16:
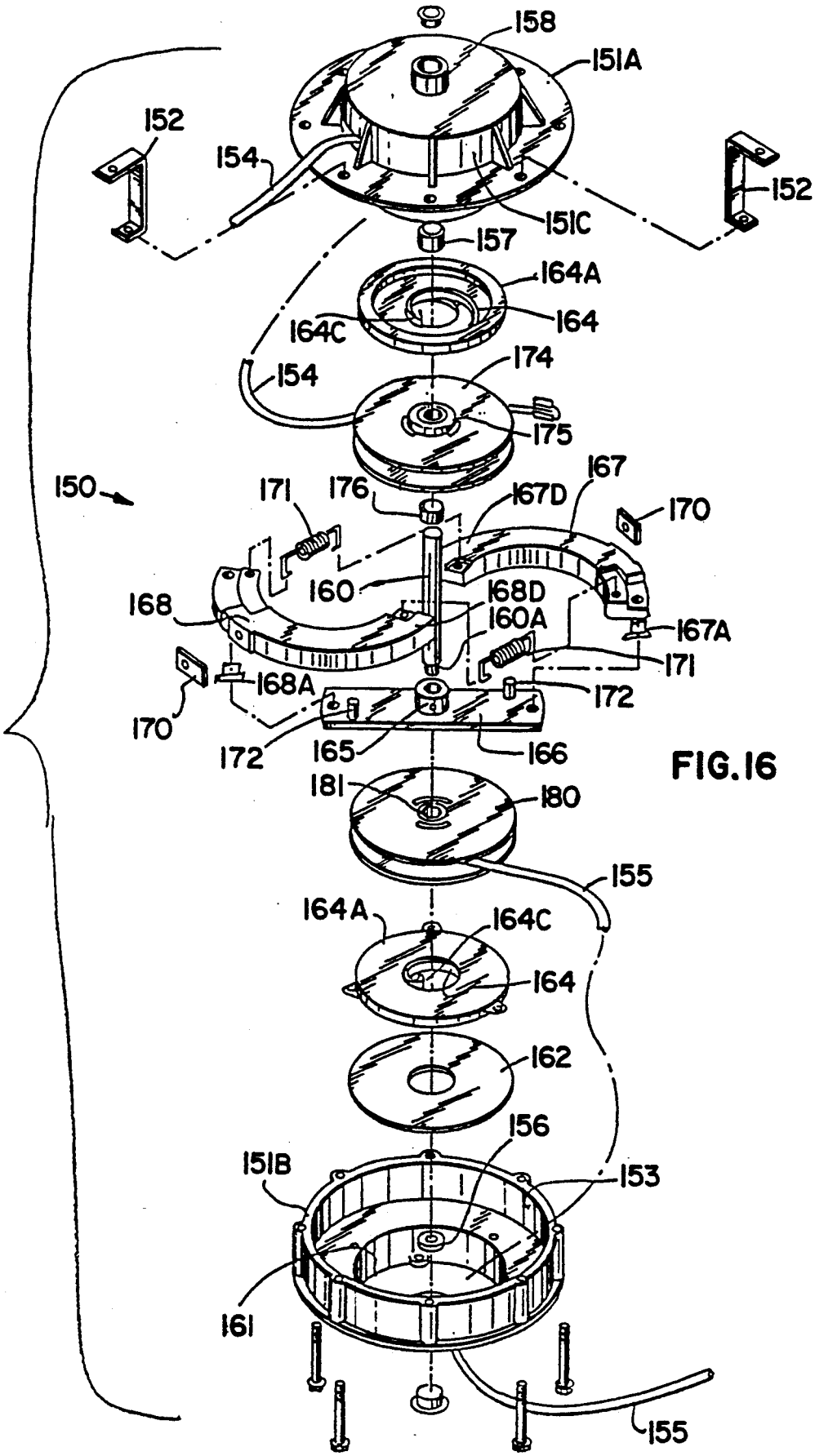
FIG. 16 is an exploded perspective view of an isokinetic device of the present invention.
Figure 17:
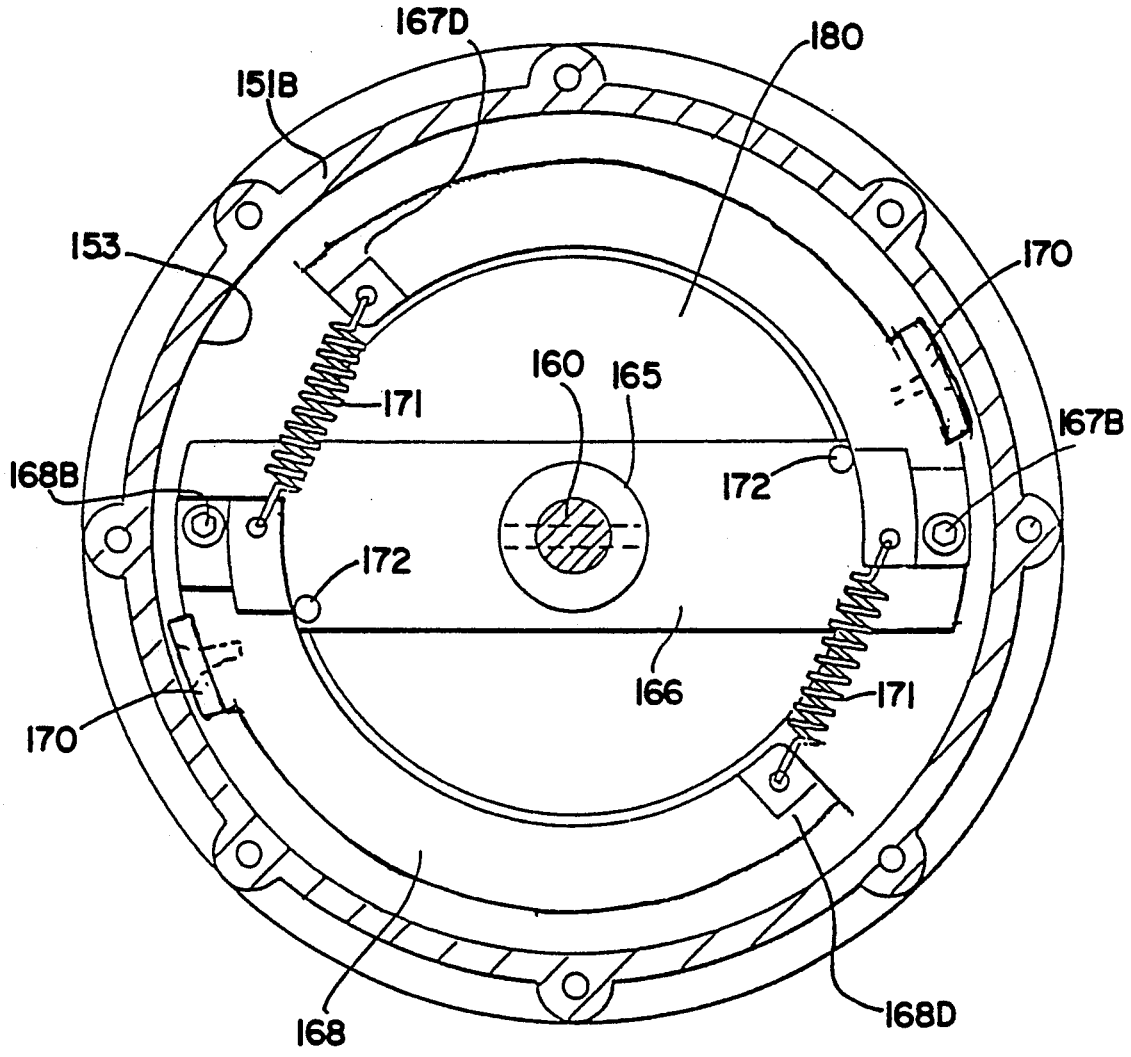
FIG. 17 is a sectional plan view of the isokinetic device shown in FIG. 16.

The isokinetic device or resistance force generating device, which forms an important part of the invention, is illustrated generally in FIG. 1, and is shown in greater detail in FIGS. 15, 16 and 17. The isokinetic device is secured onto horizontal member 12. However, it may also be secured onto the vertical member 14 as well. It is preferred to be on the horizontal member 12. Isokinetic device 20 is secured in place by bolts or rivets so that it is very rigid. The isokinetic device 20 is a centrifugal type device, and is operated by rotating a rotor through pull cords or lines. The rotor is braked to generate loading forces. The pull cords or lines are made so that they will be pulled by the person exercising at differing locations in order to provide loading for the muscles of the user in a desired direction.

An internal central rotor in the isokinetic device 20 is rotated through the use of first and second pull cords or lines 22 and 24, respectively, that exit from the isokinetic device 20 at desired locations. The line 24, as can be seen in FIG. 1 is adjacent a top side of the central rotor housing portion 110, and the line 22 is adjacent the lower side. The lines 22 and 24 are independently operable (extendable and retractable) to provide individual driving of the rotor and thus loading of the cords or lines.

Figure 14:
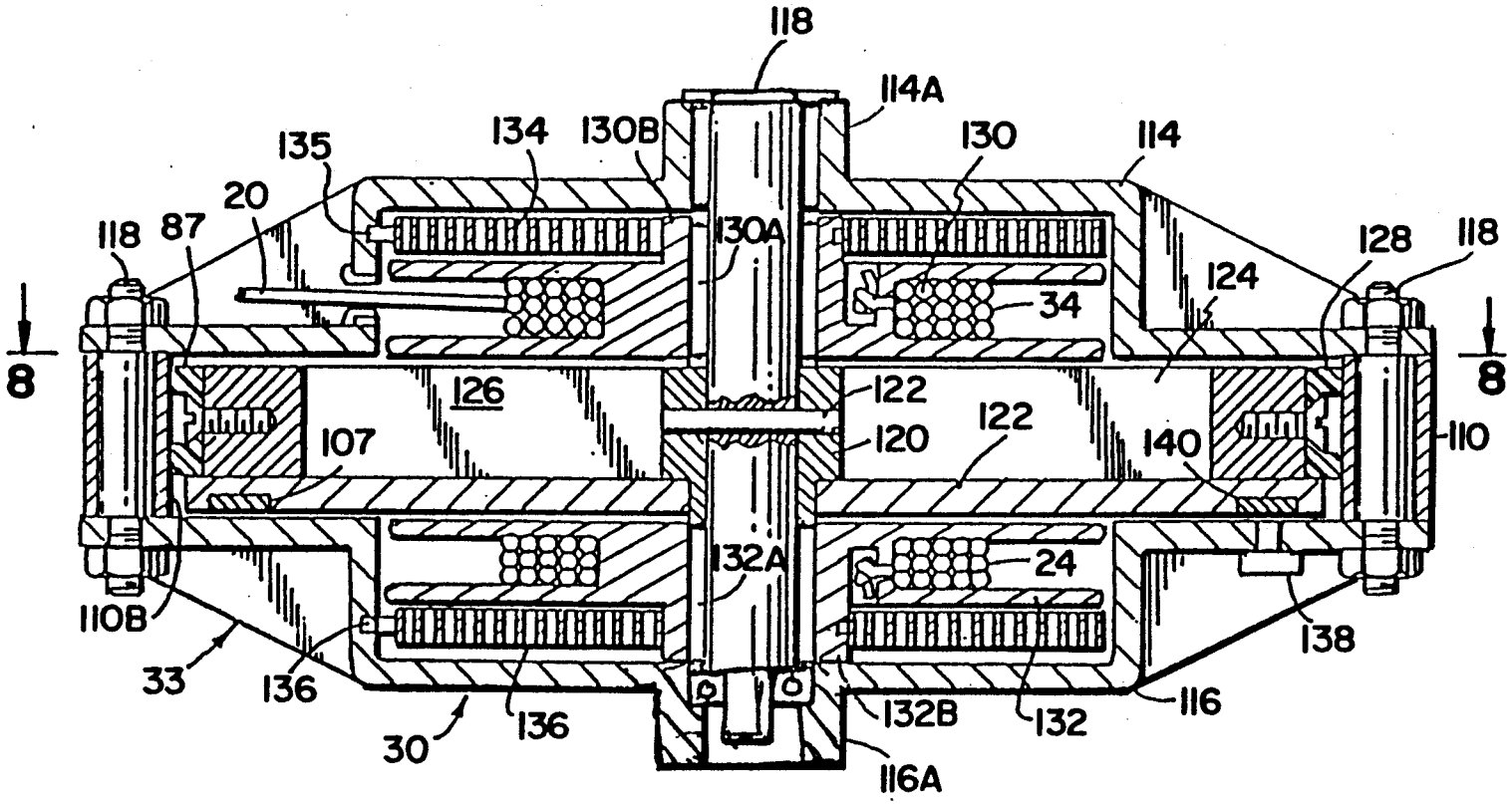
FIG. 14 is an enlarged sectional view of an exercise resistance force loading device of the present invention taken on line 8—8 in FIG. 1.

The isokinetic device 20 is independently operable by the two lines or cords 22 and 24, to drive the movable interior resistance force loading member. As shown in FIGS. 14 and 15, the outer housing 112 has a central annular housing portion 110 that has end caps 114 and 116, respectively, on the top and bottom of center portion 110. One end cap can be cast integrally with the center portion. As shown, there are studs and bolts 119 that hold the top and bottom caps 114 and 116 onto the central housing 110. The end caps 114 and 116 have hubs 114A and 116A that contain suitable low friction bearings for mounting a shaft 118, so that the shaft 118 is rotatably mounted in the two end caps 114 and 116 and is held axially in place. The shaft 118, in turn, drivably mounts a hub 120, which is held with a pin 122 to the shaft 118. The hub 120 is fixed to and carries a rotor disk or plate 122. The rotor 122 thus rotates whenever the shaft 118 is rotated. The rotor 122 is a brake shoe rotor that mounts a pair of pivoted, centrifugally actuated brake shoes 124 and 126, respectively. These brake shoes are pivoted on suitable pivot pins 124 and 126 (FIG. 15) to the brake shoe rotor 122 at diametrically spaced locations positioned adjacent to but within the periphery of the rotor.

The center section 110 of housing 112 forms a brake drum having an interior brake drum surface 112B, and each of the shoes 124 and 126 carries a separate brake friction pad 128 thereon. The friction pad 128 can be a relatively small pad of suitable brake shoe material held in a desired annular location on the brake shoes. The loading action of the brake shoes from inertial forces acting through the brake pads provides an adequate resistance force as the brake shoe rotor 122 is rotated. The brake shoes 124 and 126 are centrifugally actuated flywheel weights that will pivot outwardly under centrifugal force when the brake rotor is rotated. The pivot pins 124 and 126 are selected to be very low friction, to make the action of the brakes satisfactory for operation. The position of the brake pads 128 relative to the pivot pins 124 and 126 is selected to provide resistance force substantially instantly upon movement of the brake shoe rotor disk. The brake pads 128 are close to surface 112B for quick braking action as well.

The lines 22 and 24 are guided into the interior of the respective end caps of the housing 112 through openings in the housing and aligned with a separate top or bottom pulley for the respective lines. A pulley 130 in end cap 114A is shown for receiving the cord 22 wrapped thereon on the top side of the isokinetic device 20, (See FIG. 14). The lines 22 and 24 are anchored on the interior hub of the pulleys 130 and 132, respectively, and then wound onto the respective pulley so that there is an adequate length of cord exterior to desired location for carrying out the exercise desired.

The pulleys 130 and 132 are drivably connected to the shaft 118 through known, quick acting, roller bearing one-way clutches 130A and 132A, respectively, that are mounted on the interior of the hubs of the pulleys. The one-way clutches 130A and 132A thus are made so that they will drive the shaft 118 when the lines 22 or 24 are extended or pulled out. Any extension of either hub will immediately cause the brake shoe rotor disk 122 to start to rotate in direction as indicated by arrow 122A in FIG. 15, and when a certain RPM is reached, causing the brake shoes 124 and 126 to pivot outwardly and cause the friction brake pads 128 to engage the inner surface 110 of the housing or drum 112 and create a resistance force to resist extension of one of the lines 22 and 24 (or both), that is proportional to the force being applied to the respective lines. The speed of rotation of the rotor disk 122 will tend to increase as more force is applied to lines 22 and 24.

The pulleys 130 and 133 are free to rotate relative to shaft 118 in an opposite direction relative to the shaft 118 due to the one-way clutches, to retract the respective lines 22 and 24. Long, flat coiled torsion springs 134 and 136 are used for retraction of long lengths of the lines 22 and 24 without great increase in the retraction force. The springs 134 and 136 are coiled around hub portions 130B and 132B on the pulleys 130 and 132 respectively. One end of each long spring is anchored to the respective hubs 130B and 132B and the other end of each flat spring, at its outer periphery, is anchored as at 135 and 136, respectively, to the wall of the respective end cap 114. The fault springs 134 and 136 are fairly low force, but are also fairly uniform force as the coil changes in size. The torsion springs will wind up (tighter) as the lines 22 and 24 are extended and then when the cords are unloaded or released, the springs 134 and 136 will exert a force to rewind or retract the cords onto their respective pulleys. Thus, repeated cycling can take place with the lines being retracted each time the load on a line is released or reduced sufficiently.

The resistance force generating or loading device is thus speed sensitive, and will provide a greater resistance to extension of the lines as the speed of removal of the lines increases. The speed of removal of the lines will be proportional to the forces exerted on the exercise operable element, and thus if a rapid movement is attempted, a greater force will be exerted by the isokinetic device 20 because of greater centrifugal force on the brake shoes 124 and 126 and thus the greater frictional force between the respective pads 124A and 126A and the inner surface 110B. The amount of force that is used in the exercise can be automatically controlled and compensated. The springs 134 and 136 do not add a significant amount of overall force to extension of the cords.

If desired, a light coil can be used to tend to bias the respective brake shoes 124 and 126 inwardly about their pivot pins 124A and 126A so that there will be no friction load from the brake pads 128 upon slow outward movement of the cords 22 and 24. The resistance load will only be from the retraction springs until the rotor rotates at a sufficient speed. If the pivots 124A and 126A are quite friction free, the resistance load will pick up very rapidly. The display panel of indicators and the like is shown at FIG. 1, and can be any type of display which may be used for displaying speed of rotation of the rotor or sensing and displaying the resistance force generated by the loading device. The display can also be calibrated to display the amount of force being generated. Other displays can be counters for counting the number of times the lines 22 and 24 are cycled, using suitable sensors, such as optical or magnetic sensors. As shown, in FIG. 14, a magnetic type sensor 138 to sense the passage of magnets 140 is embedded in the brake shoe rotator disk at 122. The magnets 140 can be closely spaced around the brake shoe rotor disk 122 to insure detecting rotation almost as soon as the lines 22 and 24 are extended at all. This can provide a speed count, which is proportional to the force being generated. This type of sensor is only one type that can be utilized with the present device and is provided for illustrative purposes only.

In this form of the invention, the isokinetic device 20 indicated at 150 of FIG. 16 and 17 functions in the same manner as that illustrated in the first form of the invention, but includes certain weight reduction and housing improvements. The resistance force generating device 150 has an outer case assembly 151 that is supported through stand-off brackets 152 to and below the cross members 133. The cross members 133 are channel shaped for rigidity and lighter weight. Suitable cap screws or bolts are used to securely fasten the case assembly 157 in place. The opposite ends of the stand-off brackets 152 are securely mounted with cap screws and bolts to the outer housing 151, using the cap screws or bolts which hold the two parts of the housing together.

In FIGS. 15 and 16, the construction of the resistance force generating device 150 is illustrated in more detail. As stated previously, the resistance force generating device operates in substantially the same manner as in the first form of the invention. The outer housing or casing 151 has an upper housing portion or cap 151A, and a single lower housing section 151B, as shown in FIG. 11. The lower housing portion 151B includes the brake drum center portion integrally cast to the lower cap, and has an inner surface 153 against which the frictional brake pads will operate.

The internal brake shoe rotor of the force generating device 150 is iterated (or rotated) through the first and second pull cords or lines 154 and 155 respectively. The cords or lines 154 and 155 are mounted in upper and lower pulley assemblies, respectively, and are suitably guided over the respective pulley 138 and up through the associated vertical or upright frame member 135. As can be seen, the left frame member 135 will be slightly lower at its lower end to position that associated pulley 138 to align with the exit of the cord 155 from housing 151, for proper guidance. The cord 155 is also shown in FIG. 10.

As shown in FIG. 11, the lower housing portion 151B that includes the internal brake drum having surface 153 will support the cap 151A at the top. Each of the lower housing portion 151B and the top or upper housing portion of cap 151A has a hub that mounts a bearing for a central drive shaft 160. A roller bearing 156 is mounted in the lower housing portion, as shown in FIG. 11, and a needle bearing 157 is mounted in the hub 158 of the upper housing portion of cap 151A. The shaft 160 has a shoulder 160A that rests on bearing 156. In this form of the invention, the lower housing portion has a spring recess or pocket 161, that has an antirattle disk 162 at the bottom surface thereof. A cord retraction spring assembly 163 is mounted in this pocket 161 of the lower housing, as previously shown in the first form of the invention. However, the retraction spring 164 is inside a housing or carriage 164A. The housing 164A is made so that the spring will not fly out, and it is more easily retained if the resistance force generating unit is disassembled. A housing 164A is used in a recess formed by upper housing end portion 151C. The retraction springs are flat springs, as previously explained, and each spring has one end anchored to the respective housing or container 164A. The housings 164 in turn are fixed to the respective outer housing portion 151A or 152B at the end walls of the housing.

The central shaft 160 is drivably mounted to a hub 165 of a brake rotor 166, which comprises a rotor plate or disk. As shown, it is a strap that forms a brake shoe rotor plate which mounts a pair of pivoted, centrifugally actuated brake shoes 167 and 168, respectively. The shoes are pivotally mounted with suitable low friction bushings 167A and 168A, respectively, and then the bushings are in turn held in place with suitable pins or bolts 167B and 168B back to the brake disk rotor 166.

The hub 165 is drivably coupled to the shaft with suitable set screws in the hub, that act against the shaft. The shaft can have other types of retainers, if desired. In the resistance force generating device, the brake shoes 167 and 168 are aligned with the brake drum surface 153, and have brake pads 170, 170 mounted in suitable portions of the brake shoes adjacent to the pivot pins. The brake shoes in turn are also urged inwardly with light tension springs 171, 171 that act to hold the outer or free ends shown at 168D and 167D of the brake shoes inwardly. This will prevent brake force from initially being present when the rotor is rotated at a slow speed, and the retraction springs that were shown at 164 will provide a load as the cords are extended. The brake rotor has stop pins 172 that limit the inward pivoting of the brake shoes.

The cord 154 is mounted and wound on an upper cord pulley assembly 174, and it is guided through a suitable opening in the upper housing section 151A to align with the pulley when it is in position on the shaft 160. The pulley 174 has a central hub 175 in which a suitable one-way clutch shown at 176 on the interior of the hub 175 is mounted. This one-way clutch is drivably mounted in the hub 175, and will cause the pulley 174 to drive the shaft 160 when the cord 154 is extended from the housing 151, but will permit freewheeling of the pulley 174 relative to the shaft 160 in the opposite direction of rotation.

The pulley hub 175 also has an attachment device for attaching the free end 164B (inner end) of the associate spring 164, so that when the pulley 174 is rotated, the flat, coiled spring 164 will be tightened to provide a retraction spring force on the pulley 174. When the cord 154 is not under load from exercising, the pulley 174 will be rotated by the spring force and freewheel relative to the shaft 160 to retract the cord.

Line 155 is mounted onto a cord pulley 180 which provides for adequate cord storage when the cord is would thereon between side flanges. The pulley 180 also has a hub with a central bore in which a one-way clutch 181 is mounted. The pulley has a lower hub end that is identical to the hub end 175, but which is not shown in FIG. 11, that is used for connecting to the inner end 164C of the associated spring 164, so that when the cord 155 is extended, the one-way clutch in the bore 181 will drive the shaft 160, in the same direction of rotation as the driving force on the cord 154, causing the shaft 160 to rotate and, of course, the brake rotor 166 to also rotate so that when a certain speed is exceeded, the brake shoes 167 and 168 will move outwardly under centrifugal force and cause the brake shoe pads 170 to engage the surface 153 and provide a resistance force.

The restriction spring 164 that is associated with the pulley 180 will be tightened as the cord 155 is extended. The cord 155 extends through a suitable aperture in the lower housing section 151B, as shown in the previous form of the invention. When the cord 155 is released, after being extended during exercise, the retraction spring 164 for the pulley 180 will rotate the pulley to retract the line or cord 155 and the one-way clutch in the bore 181 will permit this retraction without driving or dragging on the shaft 160. The inner ends of the cords 154 and 155 are suitably attached to the inner hubs of the pulleys 174 and 180, respectively, in a known manner between the side flanges of the pulleys. Likewise, the outer ends of the springs 164, as stated are anchored to the housings 163, which, in turn, were anchored to the housing sections 151A and 151B.

The resistance force generating device 150 is speed sensitive, and the more rapidly the cords 154 and 155 are extended, as previously explained, the greater the resistance force that will be generated. Thus, isokinetic exercises are easy to perform because the resistance force of the isokinetic device 20 will increase to match the force applied through the cords or lines 20 and 24 or 154 and 155. No large weights are lifted to provide resistance, nor are there any weights which can fall or cause a muscle strain. The resistance stops as soon as the applied force to the cords or lines is removed.

The electronic panel on the readout can be LED readouts, to digitally show the pounds of pull and also be set to provide a signal when a desired load is reached. The sensor 138 can provide a count of the number of repetitions to ensure that a complete exercise program is being followed.

Referring to FIGS. 19–28, a line guidance and tension measuring device according to the principle of the present invention is designated generally as 200. This preferred embodiment 200 is comparable to the element designated generally as 45 in FIG. 3. As briefly described above, the preferred embodiment device 200 guides lines 22 and 24 to isokinetic resistance mechanism 20, and measures the resistive force provided by isokinetic resistance mechanism 20 during exercises. The line guidance and tension measuring device 200 generally includes fixed member 210, pivoting (or movable) member 220, sliding member 230, load bearing pulleys 240*a* and 240*b*, strain gauge 250, intermediate guide pulleys 260*a* and 260*b*, and distal guide pulleys 270*a* and 270*b*. The sliding member 230 and the strain gauge 250 combine to operate as an incremental deflection measuring means.

The line guidance and tension measuring device 200 is mounted to isokinetic resistance mechanism 20 by fixed member 210, between the isokinetic resistance mechanism 20 and vertical member 14. Fixed member 210 is comprised of U-shaped bracket 212 and secondary bracket 215, which are welded together to form an integral unit. U-shaped bracket 212 is made from a single plate of metal bent along two parallel edges to form top and bottom surfaces 213*a* and 213*b*. Operating surface 211 is a substantially continuous surface spanning portions of U-shaped bracket 212 and secondary bracket 215, and occupying a vertical plane perpendicular to the longitudinal axis of horizontal member 12. Fixed member 210 is affixed to isokinetic resistance mechanism 20 by means of holes 214*a* and 214*b* in top surface 213*a*, and holes 214*c* and 214*d* in bottom surface 213*b*.

Secondary bracket 215 is also made from a single plate of metal. Secondary bracket 215 has pivot flanges 216*a* and 216*b*, which are oriented in a vertical plane perpendicular to operating surface 211, and define holes 217*a* and 217*b*, respectively. Cylindrical tube 226 is integrally welded to pivoting member 220 in pivoting notch 227, between pivot flanges 216*a* and 216*b*, located proximate to operating surface 211 in the bottom corner of pivoting member 220. Bolt 218 passes through cylindrical tube 226 to pivotally secure pivoting member 220 to secondary bracket 215. Pivoting member 220 pivots in a vertical plane in the direction of arrow 229, perpendicular to operating surface 211.

Figure 27:
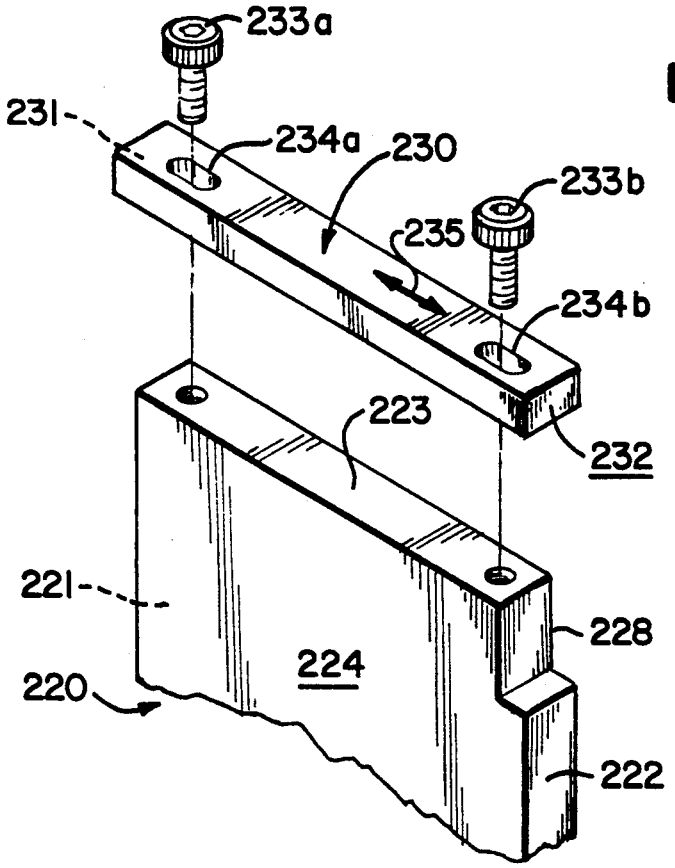
FIG. 27 is an exploded view of the attachment of the sliding member to the pivoting member for the device shown in FIG. 19.

Pivoting member 220 is substantially block-shaped, having three pairs of parallel surfaces One such pair of surfaces includes a leading surface 221, and a trailing surface 222, both of which are substantially parallel to operating surface 211. Pivoting member 220 is pivotally secured relative to fixed member 210 in such a manner that leading surface 221 is proximate to operating surface 211. A second pair of parallel surfaces includes left face 224 and right face 225, both of which are parallel to the plane of rotation of pivoting member 220. Additionally, pivoting member 220 has a sliding surface 223, on the top of pivoting member 220, as shown in FIG. 27. Pivoting member 220 also defines a notch 228, which is located at the intersection of trailing surface 222 and sliding surface 223 such that the central portion of strain gauge 250 does not contact any part of pivoting member 220.

A sliding member 230 is slidably secured to sliding surface 223 of pivoting member 220 by pins 233*a* and 233*b* extending through oval-shaped holes 234*a* and 234*b*, respectively, in sliding member 230. Sliding member 230 is free to slide lengthwise along sliding surface 223 in the direction indicated by arrow 235. Sliding member 230 is also block-shaped, having three sets of parallel surfaces, including first end surface 231 and second end surface 232, both of which are parallel to leading surface 221 and trailing surface 222. First end surface 231 extends slightly beyond leading surface 221, such that first end surface 231 is forced into contact with a portion of operating surface 211 (located on secondary bracket 215 of fixed member 210) upon movement of the pivoting member 220 toward the fixed member 210. Second end surface 232 is in the same plane as trailing surface 222.

Strain gauge 250 is attached at a first end 251 to trailing surface 222 of pivoting member 220 and at a second end 252 to second end surface 232 of sliding member 230. The strain gauge 250 measures strain induced by the movement of sliding member 230 relative to sliding surface 223 in the presence of tension in a flexible line. Strain gauge 250 also limits the movement of sliding member 230 in the absence of tension in either of lines 22 or 24. Strain gauge 250 converts the measured strain to a representative electrical signal, which is forwarded to an output device such as that designated as 32 in FIG. 1. The electronic display readout converts the signal to a load value and displays this value to the user.

Load bearing pulleys 240*a* and 240*b* are attached to pivoting member 220 on left face 224 and right face 225, respectively, proximate trailing surface 222. They are affixed to pivoting member 220 at their centers by bolt 241, which passes through both load bearing pulleys 240*a* and 240*b*, as well as through hole 244 in pivoting member 220. The load bearing pulleys 240*a* and 240*b* share a common axis of rotation (denoted by arrow 243), and their planes of rotation are parallel to the plane of pivoting of pivoting member 220. Finally, rotation of load bearing pulleys 240*a* and 240*b* is facilitated by bearing assemblies 242*a* and 242*b*. Load bearing pulleys 240*a* and 240*b* carry lines 22 and 24, respectively, and work in cooperation with intermediate guide pulleys 260*a* and 260*b* and distal guide pulleys 270*a* and 270*b*, respectively, to route the lines between exercise members and isokinetic resistance mechanism 20.

Intermediate guide pulleys 260*a* and 260*b* are located on U-shaped bracket 212 of fixed member 210. Lower intermediate guide pulley 260*a* is mounted to bottom surface 213*b* of U-shaped bracket 212 by bolt/nut combination 261*a*, which passes through the center of intermediate guide pulley 260*a*. The pulley rotates in a plane located below and parallel to bottom surface 213*b*, and it shares a common tangent, denoted by tangent line 262*a*, with load bearing pulley 240*a*, along that side of intermediate guide pulley 260*a* which is proximate to the left edge of bottom surface 213*b*. In such a configuration, line 22 passes over load bearing pulley 240*a* and around intermediate guide pulley 260*a* and is deflected off to the right of line guidance and tension measuring device 200 (when viewed from the front) into isokinetic resistance mechanism 20.

Upper intermediate guide pulley 260*b* is located on the top of U-shaped bracket 212, on top surface 213*a*. It is mounted to top surface 213*a* by bolt/nut combination 261*b*, which passes through the center of intermediate guide pulley 260*b*. The pulley rotates in a plane located above and parallel to top surface 213*a*, and shares a common tangent, denoted by tangent line 262*b*, with load bearing pulley 240*b*, along that side of intermediate guide pulley 260*b* which is proximate to the center of top surface 213*a*. In such a configuration, line 24 passes over load bearing pulley 240*b* and around intermediate guide pulley 260*b* and is deflected off to the right of line guidance and tension measuring device 200 (when viewed from the front) into isokinetic resistance mechanism 20.

Distal guide pulleys 270*a* and 270*b* are located on secondary bracket 215 of fixed member 210. Distal guide pulley 270*a* is located on guide pulley flange 219*a*, which is parallel to pivot flanges 216*a* and 216*b*. In a preferred embodiment, guide pulley flange 219*a* is turned the opposite way of pivot flanges 216*a* and 216*b* such that it is directly above top surface 213*a*. Distal guide pulley 270*a* is located on the outside of guide pulley flange 219*a* above load bearing pulley 240*a*, and directly above top surface 213*a*. Distal guide pulley 270*a* is attached to guide pulley flange 219*a* by bolt/nut combination 271*a* through the center of distal guide pulley 270*a*. The pulley rotates in the same plane as load bearing pulley 240*a*, and it shares a common tangent, denoted by tangent line 272*a*, with load bearing pulley 240*a*. In such a configuration, a line passing over distal guide pulley 270*a* is deflected approximately 180 degrees before reaching load pulley 240*a*.

Distal guide pulley 270*b* is located on guide pulley flange 219*b*, which is parallel to pivot flanges 216*a* and 216*b*. In a preferred embodiment, guide pulley flange 219*b* is an integral portion of pivot flange 216*b*. Distal guide pulley 270*b* is located on the inside of guide pulley flange 219*b* below load bearing pulley 240*b*. Distal guide pulley 270*b* is attached to guide pulley flange 219*b* by bolt/nut combination 271*b* through the center of distal guide pulley 270*b*. The pulley rotates in the same plane as load bearing pulley 240*b*, and it shares a common tangent, denoted by tangent line 272*b*, with load bearing pulley 240*b*. In such a configuration, a line entering from below line guidance and tension measuring device 200 is deflected by distal guide pulley 270*b* to approach load pulley 240*a* from a substantially horizontal orientation.

Figure 28:
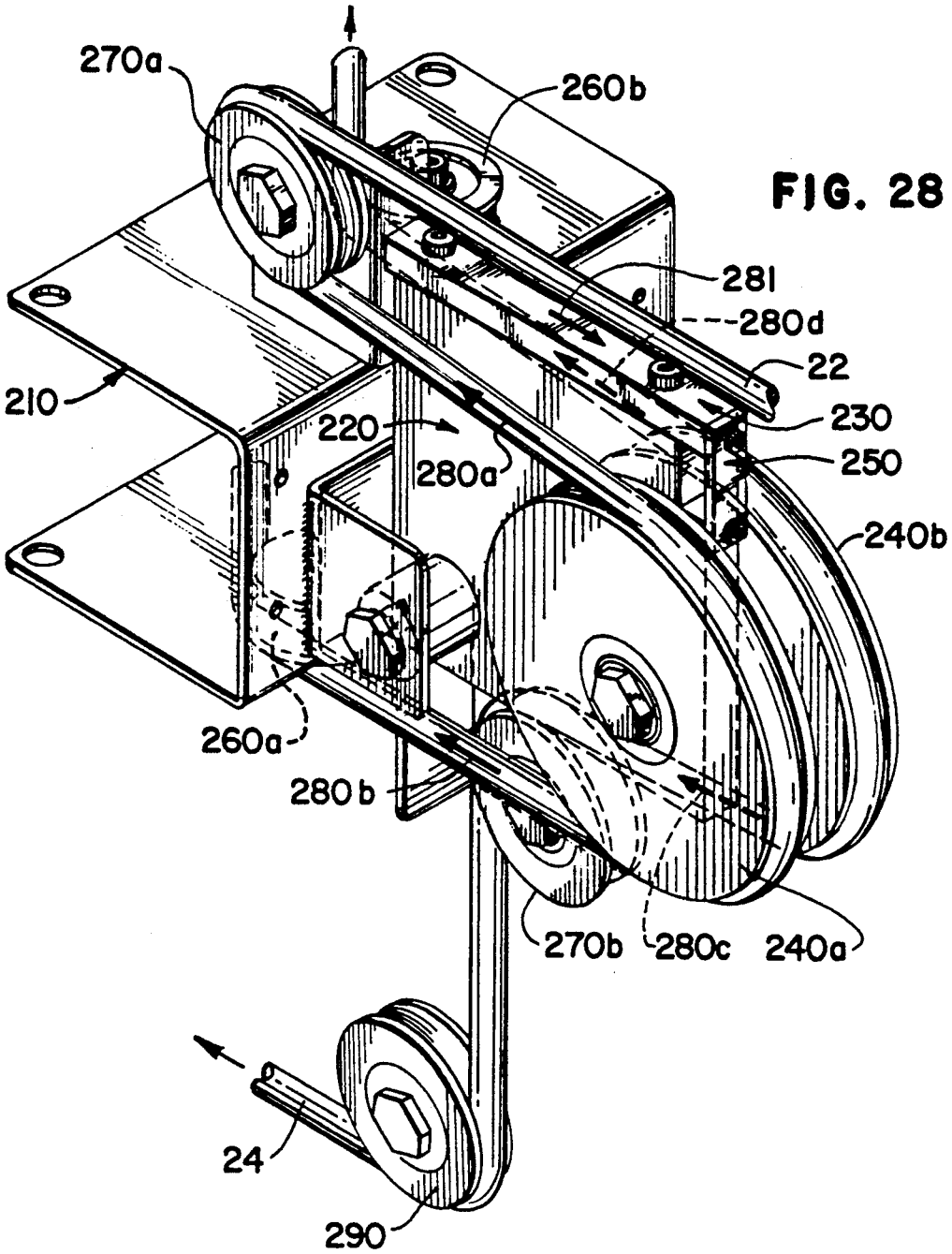
FIG. 28 is a perspective view of the flexible line guidance and tension measuring device shown in FIG. 19, showing the flexible lines as they are guided through the device.

Referring to FIG. 28, intermediate guide pulleys 260*a* and 260*b* and distal guide pulleys 270*a* and 270*b* deflect lines 22 and 24 to approach load bearing pulleys 240*a* and 240*b* in a direction perpendicular to operating surface 211. As lines 22 and 24 go around load bearing pulleys 240*a* and 240*b*, respectively, tension in the lines will induce a force on the load bearing pulleys 240*a* and 240*b*, indicated by force lines 280*a*, 280*b*, 280*c* and 280*d*, such that pivoting member 220 is pulled toward fixed member 210.

Line 22 extends from an opening in the lower half of isokinetic resistance mechanism 20 and is deflected around intermediate guide pulley 260*a* toward the load bearing pulley 240*a*. Line 22 is deflected approximately 180 degrees around load bearing pulley 240*a* toward distal guide pulley 270*a*. Line 22 is then deflected approximately 180 degrees around distal guide pulley 270*a* and beyond line guidance and tension measuring device 200 and into an opening in vertical member 14, where it ultimately is connected to an exercise member such as carriage 28.

Similarly, line 24 extends from an opening in the upper half of isokinetic resistance mechanism 20 and is deflected around intermediate guide pulley 260*b* toward the load bearing pulley 240*b*. Line 24 is deflected approximately 180 degrees around load bearing pulley 240*b* toward distal guide pulley 270*b*. Line 24 is then deflected down around distal guide pulley 270*b* and beyond line guidance and tension measuring device 200 and toward pulley 290 attached to horizontal member 12. Pulley 290 deflects line 24 to a substantially horizontal orientation, where it extends down the length of horizontal member 12 and is connected at its end to an exercise member such as L-shaped exercise element 26.

Line guidance and tension measuring device 200 not only guides lines 22 and 24 from exercise members to isokinetic resistance mechanism 20, but also measures the force provided by isokinetic resistance mechanism 20 during an exercise. For purposes of discussion, the operation of the present invention will be described with reference to a bench press exercise. As a user pushes up on bench press exercise element 30, carriage 28 is forced upward, and line 22 is pulled along with it. As the bench press exercise element 30 travels upward, isokinetic resistance mechanism 20 resistively releases more of line 22. This additional line passes through line guidance and tension measuring device 200, initially into intermediate guide pulley 260*a*, then around load bearing pulley 240*a*, and finally, out distal guide pulley 270*a*. As bench press exercise element 30 is lowered, isokinetic resistance mechanism 20 retracts the extended portion of line 22 through line guidance and tension measuring device 200 in the opposite direction, initially into distal guide pulley 270*a*, then around load bearing pulley 240*a* and out intermediate guide pulley 260*a*.

Line guidance and tension measuring device 200 simultaneously measures the load present in a flexible line that moves as a result of an exercise. As the bench press exercise element 30 travels upwards with a specified force, isokinetic resistance mechanism 20 matches that force with an equivalent resistance. The force applied by the user to the bench press exercise element translates into tension in line 22 and results in a force on load bearing pulley 240*a* and pivoting member 220 toward fixed member 210 (as shown by arrow 280*a*). The isokinetic resistance mechanism 20 exerts an opposing force to that produced by the person exercising, which similarly translates into tension in line 22 and results in a similar force on load bearing pulley 240*a* and pivoting member 220 toward fixed member 210 (as shown by arrow 280*b*).

The forces represented by lines 280*a* and 280*b* draw pivoting member 220 toward fixed member 210, and force the first end surface 231 of sliding member 230 into contact with the secondary bracket 215 of fixed member 210. An opposing force (as indicated by arrow 281) acts upon sliding member 230, causing it to slide relative to pivoting member 220, thereby inducing a strain on strain gauge 250. This resultant strain is measured by calibrated strain gauge 250, and the electrical signal representative of this measured strain is transmitted via signal line 253 to electronic display readout 32 for conversion and display.

The invention operates similarly when an exercise element such as L-shaped exercise element 26 exerts a force on line 24. The line is guided through line guidance and tension measuring device 200, via intermediate guide pulley 260*b*, load bearing pulley 240*b* and distal guide pulley 270*b*, to induce the forces indicated by 280*c* and 280*d*. Forces 280*c* and 280*d* are opposed by a force (as indicated by arrow 281), and sliding member 230 slides relative to pivoting member 220, thereby inducing a measurable strain on strain gauge 250. Therefore, the design of line guidance and tension measuring device 200 facilitates simultaneous, yet independent guidance of lines 22 and 24 between exercise elements and isokinetic resistance mechanism 20.

Finally, it is important to note that the measuring function of line guidance and tension measuring device 200 is essentially independent of the guidance function. Therefore, forces may be measured by the device without introducing any significant additional forces to the system, or without altering the performance of exercise apparatus 10 in any significant way. Thus, line guidance and tension measuring device 200 allows multiple independent lines to be guided to a single resistance device, and allows force measurement of the multiple independent lines by one single device. Due to line guidance and tension measuring device 200, the number of components required for an exercise apparatus such as exercise apparatus 10 is reduced, thereby promoting efficiency and simplicity of the apparatus.

Although the present invention has been described with reference to preferred embodiments, those skilled in the art will recognize that changes may be made without departing from the spirit and scope of the invention. For instance, it would be obvious to one practiced in the art that pivoting member 220 would not be limited to pivoting from its bottom proximate corner, and could instead be attached at its top proximate corner, wherein sliding surface 223 would be the bottom surface of pivoting member 220, and wherein sliding member 230 would be attached on the bottom of sliding surface 223.

Additionally, it would be obvious to one practiced in the art that line guidance and tension measuring device 200 need not be oriented or positioned in any specific manner, just that it have access to both ends of lines 22 and 24. For example, the present invention would also function with little modification if connected upside-down to the isokinetic resistance mechanism 20. Alternatively, distal guide pulleys 270*a* and 270*b*, and intermediate guide pulleys 260*a* and 260*b*, could be interposed, so that line 22 entered line guidance and tension measuring device 200 from below, and line 24 entered from above. It is also conceivable that the invention would still operate without any guide pulleys.

It would also be obvious to one practiced in the art that a pivoting member need not be pivotally attached to fixed member 210, nor that tension in the line draw a pivoting member toward fixed member 210. For example, an alternative embodiment could incorporate a movable member in lieu of pivoting member 220 that is slidably attached to fixed member 210. In such an embodiment, deflection could be measured equally well were the load bearing pulleys 240*a* and 240*b* pulled toward or away from fixed member 210.

Also, by including more load bearing pulleys, intermediate guide pulleys and distal guide pulleys, several lines may be accommodated without compromising any of the benefits of the invention. Thus, the scope of the present invention is to be limited only by the following claims.

What is claimed is:

1. A flexible line guidance and tension measuring device for use on an exercise apparatus to guide a flexible line from a resistance mechanism to an exercise member and measure tension in the flexible line, comprising:

(a) a fixed member arranged and configured so as to be operatively securable to an exercise apparatus, said fixed member having an operating surface;

(b) a movable member pivotally mounted to said fixed member at one operative connection, said connection being at the point about which said movable member pivots, and said movable member movable among a plurality of positions relative to said operating surface;

(c) a load bearing pulley rotatably mounted on said movable member, wherein when a movement is induced in said movable member from one of said plurality of positions to another of said plurality of positions relative to said operating surface, an incremental deflection is defined; and (d) an incremental deflection measuring means operatively mounted to said moveable member, for measuring said incremental deflection of said movable member relative to said operating surface; said (e) an intermediate guide pulley rotatably mounted on said fixed member and designed to guide a flexible line from a first location to said load bearing pulley, wherein said intermediate guide pulley rotates in a plane perpendicular to both said operating surface and the plane of rotation of said load bearing pulley, and wherein said intermediate guide pulley shares a common tangent with said load bearing pulley; and (f) a distal guide pulley rotatably mounted on said fixed member and designed to guide a flexible line from said load bearing pulley to a second location, wherein said distal guide pulley rotates in the plane of rotation of said load bearing pulley, and wherein said distal guide pulley shares a common tangent with said load bearing pulley;

(g) wherein said incremental deflection measuring means includes:

(i) a sliding member slidably secured relative to a sliding surface on said movable member, wherein said sliding member has a first end surface and a second, opposite, end surface, and said first end surface extends beyond a leading surface on said movable member, such that said first end surface contacts said operating surface of said fixed member upon movement of said moveable member toward said fixed member;

(ii) a strain gauge having a first end mounted to a trailing surface on said movable member, and a second end mounted to said second end surface of said sliding member, whereby when a movement is induced in said movable member, said first end surface is forced against said operating surface, thereby inducing a measurable strain on said strain gauge.

2. The flexible line guidance and tension measuring device of claim 1, wherein said sliding surface is substantially perpendicular to said operating surface of said fixed member, said leading surface and said trailing surface of said movable member are substantially parallel to said operating surface and said trailing surface of said movable member is notched behind a central portion of said strain gauge.

3. The flexible line guidance and tension measuring device of claim 2, further comprising an output means for converting a signal from said strain gauge into a value representative of load on the resistance mechanism and indicating said value to a user.

4. A flexible line guidance and tension measuring device for use on an exercise apparatus to guide a flexible line from a resistance mechanism to an exercise member and measure tension in the flexible line, comprising:

(a) a fixed member arranged and configured so as to be operatively securable to an exercise apparatus, said fixed member having an operating surface;

(b) a movable member pivotally mounted to said fixed member and movable in a plane generally perpendicular to said operating surface of said fixed member and among a plurality of positions relative to said operating surface, said plurality of positions defined along an arc defined by movement of said moveable member in the generally perpendicular plane;

(c) a load bearing pulley rotatably mounted on said movable member and rotatable in a plane generally parallel to the generally perpendicular plane, wherein whenever a movement of said movable member is induced, of the type induced by a tensioned flexible line, from one of said plurality of positions to another of said plurality of positions relative to said operating surface, an incremental deflection is defined; and (d) an incremental deflection measuring means operatively mounted to said movable member, for measuring said incremental deflection of said movable member relative to said operating surface; said incremental deflection measuring means including (i) a sliding member slidably secured relative to a sliding surface on said movable member, wherein said sliding member has a first end surface and a second, opposite, end surface, and said first end surface extends beyond a leading surface on said moveable member, such that said first end surface contacts said operating surface of said fixed member upon movement of said movable member toward said fixed member;

(ii) a strain gauge having a first end mounted to a trailing surface on said movable member, and a second end mounted to said second end surface of said sliding member, whereby when a movement is induced in said movable member, said first end surface is forced against said operating surface, thereby inducing a measurable strain on said strain gauge.

5. A flexible line guidance and tension measuring device for use on an exercise apparatus to guide a flexible line from a resistance mechanism to an exercise member and measure tension in the flexible line, comprising:

(a) a fixed member arranged and configured so as to be operatively securable to an exercise apparatus, said fixed member having an operating surface;

(b) a pivoting member pivotally mounted to said fixed member and having a leading surface, a trailing surface, and a sliding surface, wherein said leading surface is proximate to said operating surface on said fixed member;

(c) a sliding member slidably secured relative to said sliding surface on said pivoting member, wherein said sliding member has a first end surface and a second, opposite end surface, and said first end surface extends beyond said leading surface of said pivoting member such that said first end surface contacts said operating surface of said fixed member, upon pivoting of said pivoting member toward said fixed member;

(d) a load bearing pulley rotatably mounted on said pivoting member, wherein when a movement is induced in said pivoting member toward said fixed member, said first end surface of said sliding member is forced against said operating surface; and (e) a strain gauge having a first end mounted to said trailing surface of said pivoting member, and a second end mounted to said second end surface of said sliding member, whereby when movement is induced in said pivoting member, a measurable strain is induced on said strain gauge.

6. The flexible line guidance and tension measuring device of claim 5, further comprising an intermediate guide pulley rotatably mounted on said fixed member and designed to guide a flexible line from a first location to said load bearing pulley.

7. The flexible line guidance and tension measuring device of claim 6, wherein said intermediate guide pulley rotates in a plane perpendicular to both said operating surface and the plane of rotation of said load bearing pulley, and wherein said intermediate guide pulley shares a common tangent with said load bearing pulley.

8. The flexible line guidance and tension measuring device of claim 5, further comprising a distal guide pulley rotatably mounted on said fixed member and designed to guide a flexible line from said load bearing pulley to a second location.

9. The flexible line guidance and tension measuring device of claim 8, wherein said distal guide pulley rotates in the plane of rotation of said load bearing pulley, and wherein said distal guide pulley shares a common tangent with said load bearing pulley.

10. The flexible line guidance and tension measuring device of claim 5, wherein said pivoting member pivots in a plane perpendicular to said operating surface of said fixed member, and wherein said sliding surface of said pivoting member is substantially perpendicular to said operating surface of said fixed member.

11. The flexible line guidance and tension measuring device of claim 5, wherein said leading surface and said trailing surface of said pivoting member are substantially parallel to said operating surface of said fixed member.

12. The flexible line guidance and tension measuring device of claim 5, wherein said trailing surface of said pivoting member is notched behind a central portion of said strain gauge.

13. The flexible line guidance and tension measuring device of claim 5, wherein said load bearing pulley rotates in a plane parallel to the plane of pivoting of said pivoting member.

14. The flexible line guidance and tension measuring device of claim 5, further comprising an output means for converting a signal from said strain gauge into a value representative of load on the resistance mechanism and indicating said value to a user.

15. The flexible line guidance and tension measuring device of claim 5, further comprising:

(a) an intermediate guide pulley rotatably mounted on said fixed member and designed to guide a flexible line from a first location to said load bearing pulley, wherein said intermediate guide pulley rotates in a plane perpendicular to both said operating surface and the plane of rotation of said load bearing pulley, and wherein said intermediate guide pulley shares a common tangent with said load bearing pulley;

(b) a distal guide pulley rotatably mounted on said fixed member and designed to guide a flexible line from said load bearing pulley to a second location, wherein said distal guide pulley rotates in the plane of rotation of said load bearing pulley, and said distal guide pulley shares a common tangent with said load bearing pulley; and wherein said pivoting member pivots in a plane perpendicular to said operating surface of said fixed member; said load bearing pulley rotates in a plane parallel to the pane of pivoting of said pivoting member; said sliding surface of said pivoting member is substantially perpendicular to said operating surface of said fixed member; said leading surface and said trailing surface of said pivoting member are substantially parallel to said operating surface of said fixed member; and said trailing surface of said pivoting member is notched behind a central portion of said strain gauge; and (c) an output means for converting a signal from said strain gauge into a value representative of load on the resistance mechanism and indicating said value to a user.

* * * * *